US009671711B2

(12) United States Patent
Shimazoe et al.

(10) Patent No.: US 9,671,711 B2
(45) Date of Patent: Jun. 6, 2017

(54) IMAGE FORMING APPARATUS

(71) Applicant: Konica Minolta, Inc., Chiyoda-ku, Tokyo (JP)

(72) Inventors: Makoto Shimazoe, Toyokawa (JP); Akihiro Hayashi, Okazaki (JP); Hiroyuki Yoshikawa, Toyohashi (JP); Toshikazu Higashi, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/932,434

(22) Filed: Nov. 4, 2015

(65) Prior Publication Data

US 2016/0139531 A1 May 19, 2016

(30) Foreign Application Priority Data

Nov. 19, 2014 (JP) ..... 2014-234919

(51) Int. Cl.
*G03G 15/00* (2006.01)
*G03G 15/02* (2006.01)
*G03G 15/01* (2006.01)

(52) U.S. Cl.
CPC ..... *G03G 15/0266* (2013.01); *G03G 15/0136* (2013.01); *G03G 15/80* (2013.01)

(58) Field of Classification Search
CPC ..... G03G 15/5008; G03G 15/0266; G03G 15/01; G03G 15/80
(Continued)

(56) References Cited

U.S. PATENT DOCUMENTS 5,276,602 A * 1/1994 Oku ..... H02M 3/33515 363/21.13
5,933,687 A * 8/1999 Okuno ..... G03G 15/01 399/167
(Continued)

FOREIGN PATENT DOCUMENTS

JP 2000-333458 A 11/2000
JP 2001-324850 A 11/2001
(Continued)

OTHER PUBLICATIONS

Notice of Reasons of Rejection dated Nov. 21, 2016 issued in the corresponding Japanese Patent Application No. 2014-234919 and English translation (25 pages).

*Primary Examiner* — G. M. Hyder
(74) *Attorney, Agent, or Firm* — Buchanan Ingersoll & Rooney PC

(57) ABSTRACT

An image forming apparatus includes: a plurality of image forming units forming an image in the corresponding color by electrophotographic system; a high-voltage power supply circuit capable of generating a bias voltage; and a control unit that controls a first printing mode and a second printing mode, wherein in the second printing mode, the control unit performs such control that the photosensitive bodies provided on the image forming units not used in the second printing mode continuously rotate at a speed lower than a speed in the first printing mode, and/or such control that a bias voltage whose absolute value is less than an absolute value of a bias voltage in the first printing mode is supplied from the high-voltage power supply circuit to the processing components of the same type provided on the image forming units not used in the second printing mode.

15 Claims, 22 Drawing Sheets

(58) Field of Classification Search
USPC ..... 399/37
See application file for complete search history.

(56) References Cited

U.S. PATENT DOCUMENTS

| | | | | |
|---|---|---|---|---|
| 6,266,496 | B1 * | 7/2001 | Rush | G03G 15/2025 399/325 |
| 2001/0043817 | A1 * | 11/2001 | Maebashi | G03G 15/0105 399/50 |
| 2007/0292170 | A1 * | 12/2007 | Yoshioka | G03G 15/0131 399/299 |
| 2008/0056740 | A1 * | 3/2008 | Inukai | G03G 15/55 399/37 |
| 2009/0175635 | A1 | 7/2009 | Naoi et al. | |

FOREIGN PATENT DOCUMENTS

| | | | |
|---|---|---|---|
| JP | 2002-162870 | A | 6/2002 |
| JP | 2007-334255 | A | 12/2007 |
| JP | 2008-076753 | A | 4/2008 |
| JP | 2009-163030 | A | 7/2009 |
| JP | 2009-300770 | A | 12/2009 |
| JP | 2012-014145 | A | 1/2012 |

* cited by examiner

IMAGE FORMING APPARATUS

The entire disclosure of Japanese Patent Application No. 2014-234919 filed on Nov. 19, 2014 including description, claims, drawings, and abstract are incorporated herein by reference in its entirety.

BACKGROUND OF THE INVENTION

Field of the Invention

The present invention relates to an image forming unit which includes a high-voltage power supply circuit capable of generating a bias voltage based on a voltage output from a common transformer used by a plurality of image forming units, and applying the generated bias voltage to the same type of processing components provided on the image forming units.

Description of the Related Art

There is known an image forming apparatus which adopts a tandem system for realizing full-color printing, for example. This type of image forming apparatus includes an image forming unit for each color of Y (yellow), M (magenta), C (cyan), and K (black). These image forming units are linearly arranged. In these units, the image forming unit for the color K is disposed closer to a secondary transfer area described below than the image forming units for the other colors.

In a full-color printing mode, a charging unit provided on each of the image forming units uniformly charges a surface of a corresponding rotating photosensitive drum at a predetermined potential in accordance with an applied charging bias voltage. An exposure unit generates optical beams for each color based on image data, and applies the generated optical beams to a corresponding charging area. As a result, an electrostatic latent image in each color is formed on the surface of the corresponding photosensitive drum. On the other hand, a developing roller contained in a developer provided on each of the image forming units rotates while receiving a developing bias voltage to supply toner in corresponding color to the corresponding electrostatic latent image. As a result, a toner image in each color is formed.

An intermediate transfer belt contacts each of the photosensitive drums on the downstream side with respect to the developer in the rotation direction of the photosensitive drum. A primary transfer roller for each color faces the photosensitive drum for the corresponding color with the intermediate transfer belt interposed between the primary transfer roller and the photosensitive drum. This structure produces a primary transfer area for each color between the intermediate transfer belt and the corresponding photosensitive drum. A primary transfer bias voltage is applied to each of the primary transfer rollers to transfer the toner image on each of the photosensitive drums to the same area of the rotating intermediate transfer belt in the corresponding primary transfer area. As a result, a full-color toner image is formed.

The intermediate transfer belt further contacts a secondary transfer roller on a predetermined side (such as the left side) of the photosensitive drum for the color K to form a secondary transfer area. A secondary transfer bias is applied to the secondary transfer roller. As a result, a full-color toner image carried on the intermediate transfer belt is transferred to a printing medium in the secondary transfer area. This printing medium passes through a known fixing device, and reaches a tray for discharge as a printed matter.

For example, there is known a conventional image forming apparatus which includes, in view of reduction of component and manufacture costs, a high-voltage power supply circuit for generating a developing bias voltage for all colors based on a voltage output from a common transformer used by developing rollers for the all colors provided as processing components (for example, see JP 2009-163030 A and JP 2002-162870 A).

According to this conventional image forming apparatus, however, electric damage (more specifically, film reduction) may be given to the photosensitive drums for Y, M, and C colors particularly at positions facing the developing rollers for Y, M, and C colors when the developing bias voltage is constantly supplied to the developing rollers for Y, M, and C colors from the high-voltage power supply circuit in a rotation stop state of the photosensitive drums for Y, M, and C colors in a monochrome printing mode. In other words, the lives of the respective photosensitive drums for Y, M, and C colors are influenced.

In addition, it is possible that the same transformer is used for all the colors to generate the charging bias voltage and the primary transfer bias voltage. When the charging bias voltage and the primary transfer bias voltage are constantly supplied to the charging units and the primary transfer rollers for Y, M, and C colors in the monochrome printing mode in this structure, uniform charging for the surfaces of the photosensitive drums for Y, M, and C colors becomes difficult in the subsequent color printing mode. In this case, image deterioration called an image memory may be caused.

SUMMARY OF THE INVENTION

For solving the aforementioned problems, an object of the present invention is to provide an image forming apparatus capable of reducing influence on a life of a photosensitive drum and/or image deterioration.

To achieve the abovementioned object, according to an aspect, an image forming apparatus reflecting one aspect of the present invention comprises: a plurality of image forming units provided for each of a plurality of colors, each of the image forming units including a photosensitive body and a plurality of types of processing components around the photosensitive body, and forming an image in the corresponding color by electrophotographic system; a high-voltage power supply circuit capable of generating a bias voltage for the processing components of the same type based on a voltage output from one transformer; and a control unit that controls a first printing mode using a predetermined number of the image forming units, and a second printing mode using a smaller number of the image forming units than the predetermined number. In the second printing mode, the control unit performs such control that the photosensitive bodies provided on the image forming units not used in the second printing mode continuously rotate at a speed lower than a speed in the first printing mode, and/or such control that a bias voltage whose absolute value is less than an absolute value of a bias voltage in the first printing mode is supplied from the high-voltage power supply circuit to the processing components of the same type provided on the image forming units not used in the second printing mode.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming apparatus according to embodiments of the present invention will be described with reference to the drawings. However, the scope of the invention is not limited to the illustrated examples.

Section 1: Definition

Several figures referred to herein contain X axis through Z axis orthogonal to each other. The X axis, Y axis, and Z axis indicate the left-right direction, the front-rear direction, and the up-down direction of an image forming apparatus 1, respectively. Some reference numbers in this context and the respective figures are given suffixes of lowercase alphabetic characters a, b, c, and d. These suffixes d, c, b, and a indicate yellow (Y), magenta (M), cyan (C), and black (K), respectively. For example, a photosensitive drum 21*a* refers to a photosensitive drum for the color K.

Section 2: General Configuration of Image Forming Apparatus in Embodiments

Figure 1:
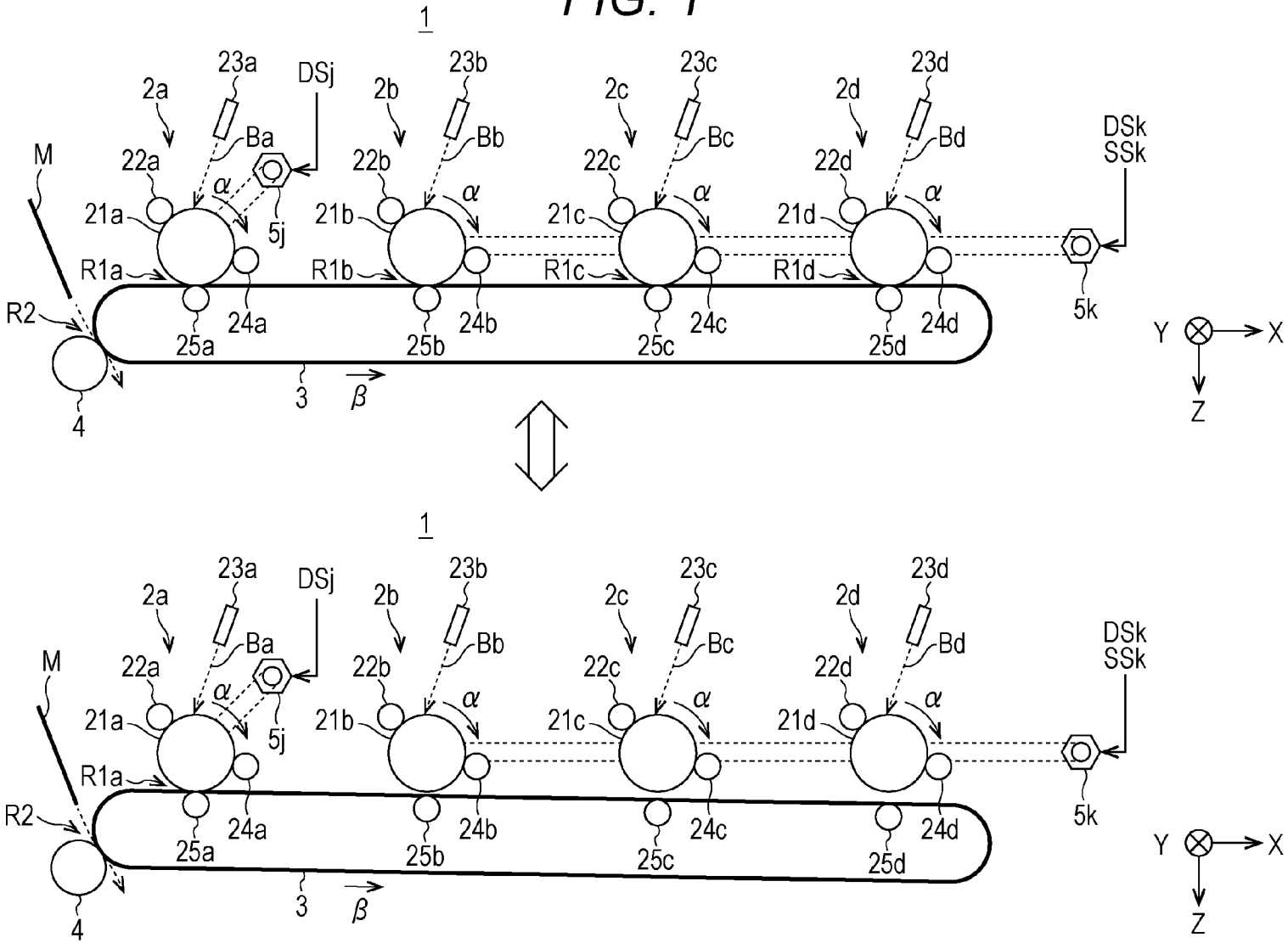
FIG. 1 is a view illustrating a general configuration of an image forming apparatus in a full-color printing mode and a monochrome printing mode.

The image forming apparatus 1 illustrated in FIG. 1 is a copy machine, a printer, a facsimile machine, or a multifunction machine having these functions, for example. The image forming apparatus 1 prints at least a full-color image or a monochrome image on a sheet-shaped printing medium M (such as a sheet) by using a known electrophotographic system or a tandem system. The image forming apparatus 1 generally includes image forming units 2*a* through 2*d*, an intermediate transfer belt 3, a secondary transfer roller 4, and motors 5*j* and 5*k* for realizing this type of printing. Respective configurations of these components are hereinafter described.

The image forming units 2*a* through 2*d* are linearly arranged. According to this description, the image forming units 2*a* through 2*d* are disposed substantially in parallel with the X axis in this order from the left to the right. The image forming unit 2*a* is closer to a secondary transfer area R2 than the other image forming units 2*b* through 2*d* to realize high-speed monochrome printing.

The image forming units 2*a* through 2*d* include photosensitive drums 21*a* through 21*d*, respectively. Each of the photosensitive drums 21*a* through 21*d* has a cylindrical shape extending in the Y axis direction, and rotates in a direction of an arrow α, for example. At least charging units 22*a* through 22*d*, developing units 24*a* through 24*d*, and primary transfer rollers 25*a* through 25*d* are disposed in this order as examples of processing components around the photosensitive drums 21*a* through 21*d*, respectively, from the upstream side to the downstream side in the rotation direction α.

The charging units 22*a* through 22*d* correspond to a first example of processing components of the same type, and have the function of charging predetermined areas (i.e., charging areas) of the photosensitive drums 21*a* through 21*d*. The surfaces of the photosensitive drums 21*a* through 21*d* rotate substantially at a constant angular speed (rotational speed), and therefore are uniformly charged by the charging units 22*a* through 22*d*.

Exposure units 23*a* through 23*d* are provided in the upper right region of the image forming units 2*a* through 2*d*, respectively. The exposure units 23*a* through 23*d* generate optical beams Ba through Bd modulated based on image data, and apply the generated optical beams Ba through Bd to exposing areas disposed on the downstream side of the charging areas of the photosensitive drums 21*a* through 21*d* immediately after the charging areas to form electrostatic latent images in corresponding colors on the corresponding exposing areas.

The developing units 24*a* through 24*d* correspond to a second example of the processing components of the same type, and supply toner in corresponding colors to developing areas on the downstream side of the photosensitive drums 21*a* through 21*d* immediately after the exposing areas to form toner images in corresponding colors on the corresponding developing areas.

The intermediate transfer belt 3 is a so-called endless belt extending between at least two rollers (not shown) disposed in the left-right direction and wound around outer circumferential surfaces of the two rollers. The intermediate transfer belt 3 rotates anticlockwise (direction indicated by an arrow β), for example.

In a full-color printing mode corresponding to a first example of a first printing mode, the outer circumferential surface of the intermediate transfer belt 3 comes into contact with the lower ends of the respective photosensitive drums 21*a* through 21*d* as illustrated in an upper stage in FIG. 1. In other words, the four (corresponding to a first example of a predetermined number) image forming units 2*a* through 2*d* are used in the full-color printing mode. On the other hand, in a monochrome printing mode corresponding to a first example of a second printing mode, a known separating function or mechanism (not shown) only allows contact between the outer circumferential surface of the intermediate transfer belt 3 and the photosensitive drum 21*a*, and separates the outer circumferential surface of the intermediate transfer belt 3 from the other photosensitive drums 21*b* through 21*d* as illustrated in a lower stage in FIG. 1. In other words, only the one image forming unit 2*a* fewer than the predetermined number is used in the monochrome printing mode. The intermediate transfer belt 3 rotates in the rotation direction β even in the separated state.

The primary transfer rollers 25*a* through 25*d* correspond to a third example of the processing components of the same type. In the full-color printing mode, the primary transfer roller 25*a* through 25*d* face the photosensitive drums 21*a* through 21*d* with the intermediate transfer belt 3 interposed between the primary transfer rollers 25*a* through 25*d* and the photosensitive drums 21*a* through 21*d* as illustrated in the upper stage in FIG. 1. The primary transfer rollers 25*a* through 25*d* press the inner circumferential surface of the intermediate transfer belt 3 upward to form contact portions between the respective photosensitive drums 21*a* through 21*d* and the intermediate transfer belt 3 (i.e., primary transfer areas R1*a* through R1*d*).

The primary transfer roller 25*a* forms the primary transfer area R1*a* between the photosensitive drum 21*a* and the intermediate transfer belt 3 even in the monochrome printing mode as illustrated in the lower stage in FIG. 1. However, the primary transfer rollers 25*b* through 25*d* are shifted together with the intermediate transfer belt 3 by the known separating function or mechanism (not shown) in a direction away from the photosensitive drums 21*b* through 21*d* as illustrated in the lower stage in FIG. 1 in the monochrome printing mode.

A primary bias voltage (detailed below) is applied to each of the primary transfer rollers 25*a* through 25*d*. Based on this voltage, the toner images on the respective photosensitive drums 21*a* through 21*d* are transferred to the rotating intermediate transfer belt 3 in the corresponding primary transfer areas R1*a* through R1*d*. As a result, a full-color toner image is synthesized on the outer circumferential surface of the intermediate transfer belt 3 in the full-color printing mode, or a monochrome toner image is formed on the outer circumferential surface of the intermediate transfer belt 3 in the monochrome printing mode.

The secondary transfer roller 4 disposed in the vicinity of the left end of the intermediate transfer belt 3 presses the outer circumferential surface of the intermediate transfer belt 3 to form the secondary transfer area R2 in the contact portion between the secondary transfer roller 4 and the intermediate transfer belt 3.

In the secondary transfer area R2, the full-color image or the monochrome image carried on the intermediate transfer belt 3 is transferred to the printing medium M. The printing medium M passes through a known fixing device, and reaches a tray for discharge as a printed matter.

Figure 2:
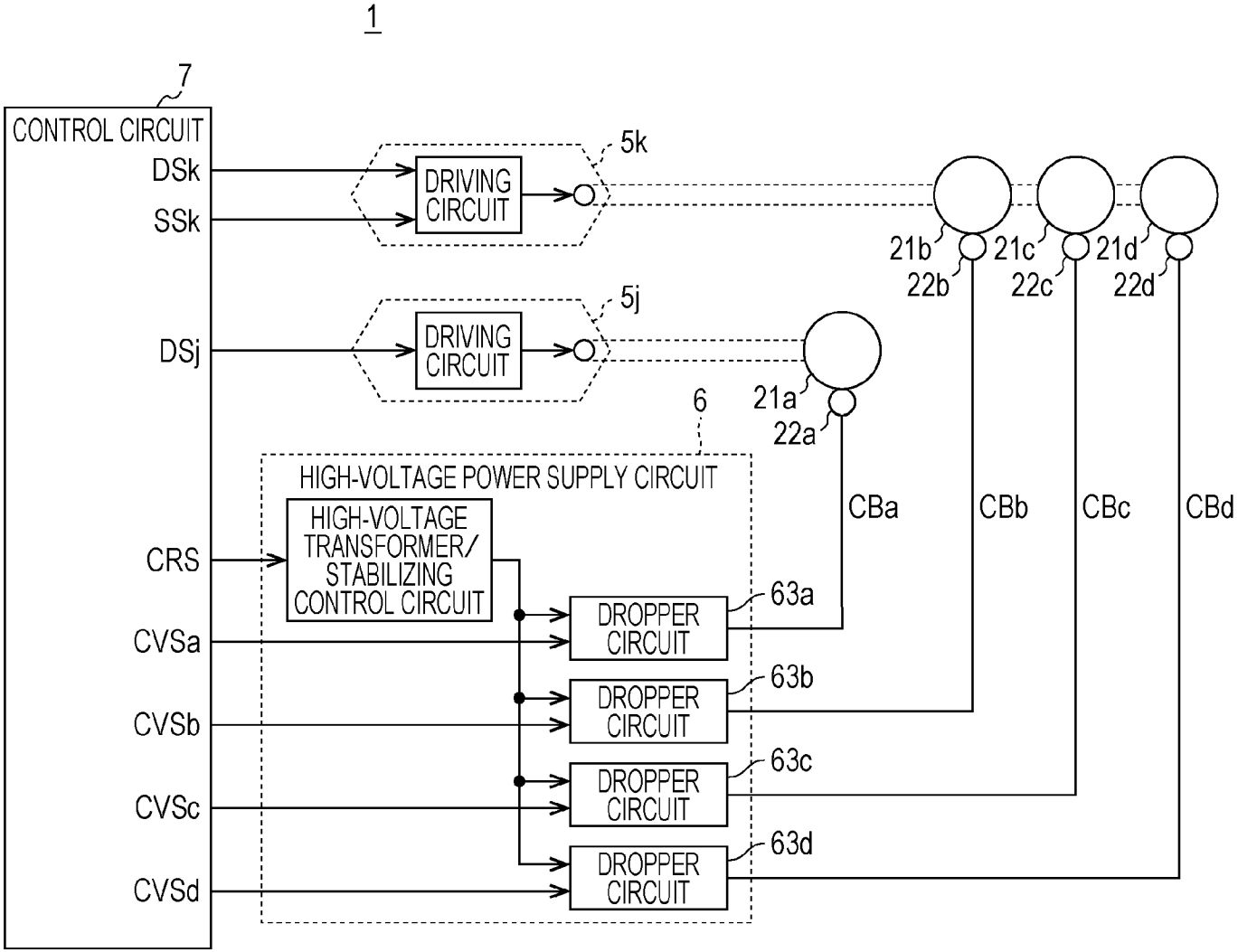
FIG. 2 is a view illustrating a high-voltage power supply circuit and a control circuit according to a first embodiment.
Figure 6:
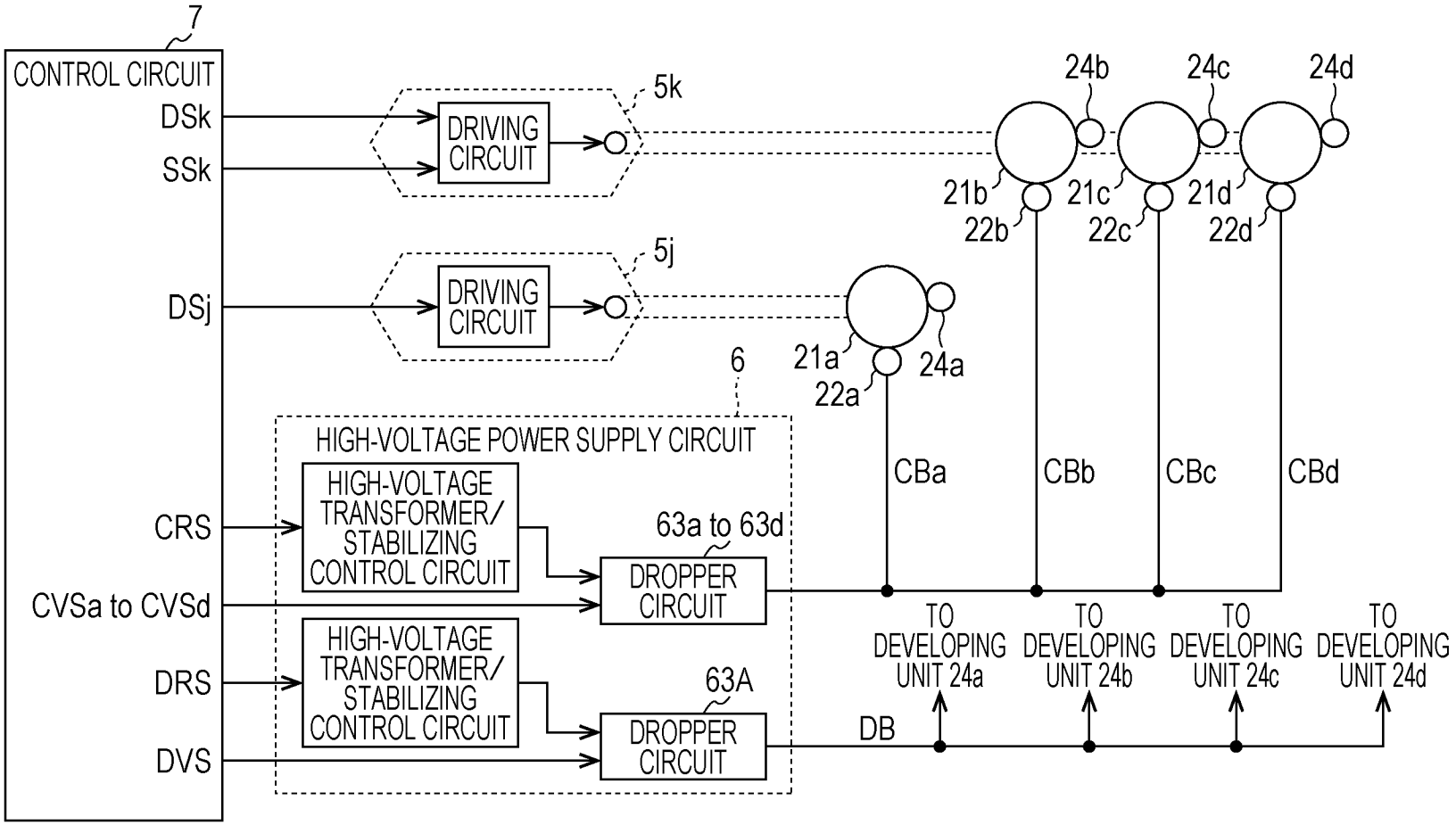
FIG. 6 is a view illustrating a high-voltage power supply circuit and a control circuit according to a second embodiment.
Figure 10:
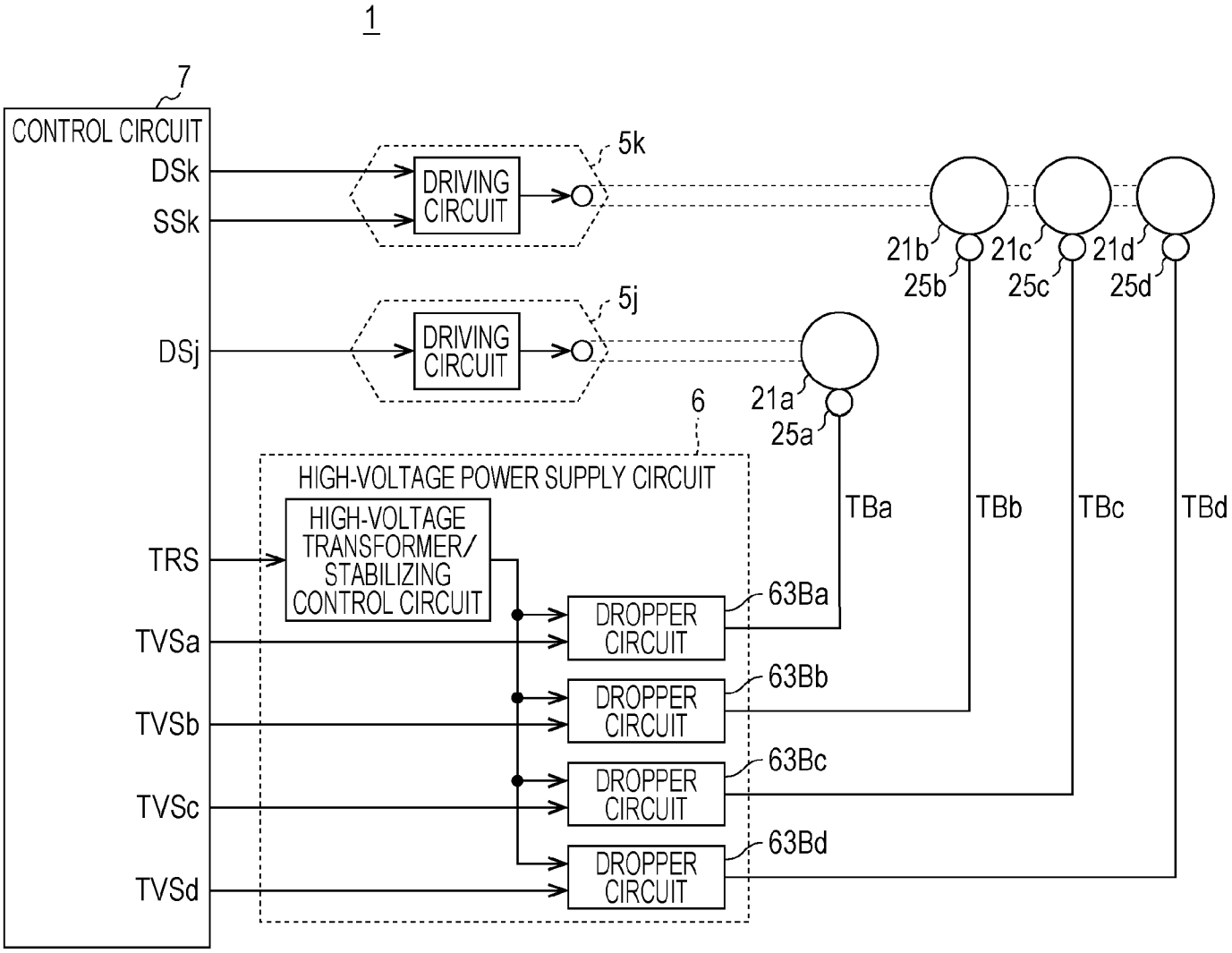
FIG. 10 is a view illustrating a high-voltage power supply circuit and a control circuit according to a third embodiment.

The motor 5*j* rotates the photosensitive drum 21*a*, while the motor 5*k* rotates the photosensitive drums 21*b* through 21*d*, under control of a control circuit 7 (see FIGS. 2, 6, and 10).

Figure 3:
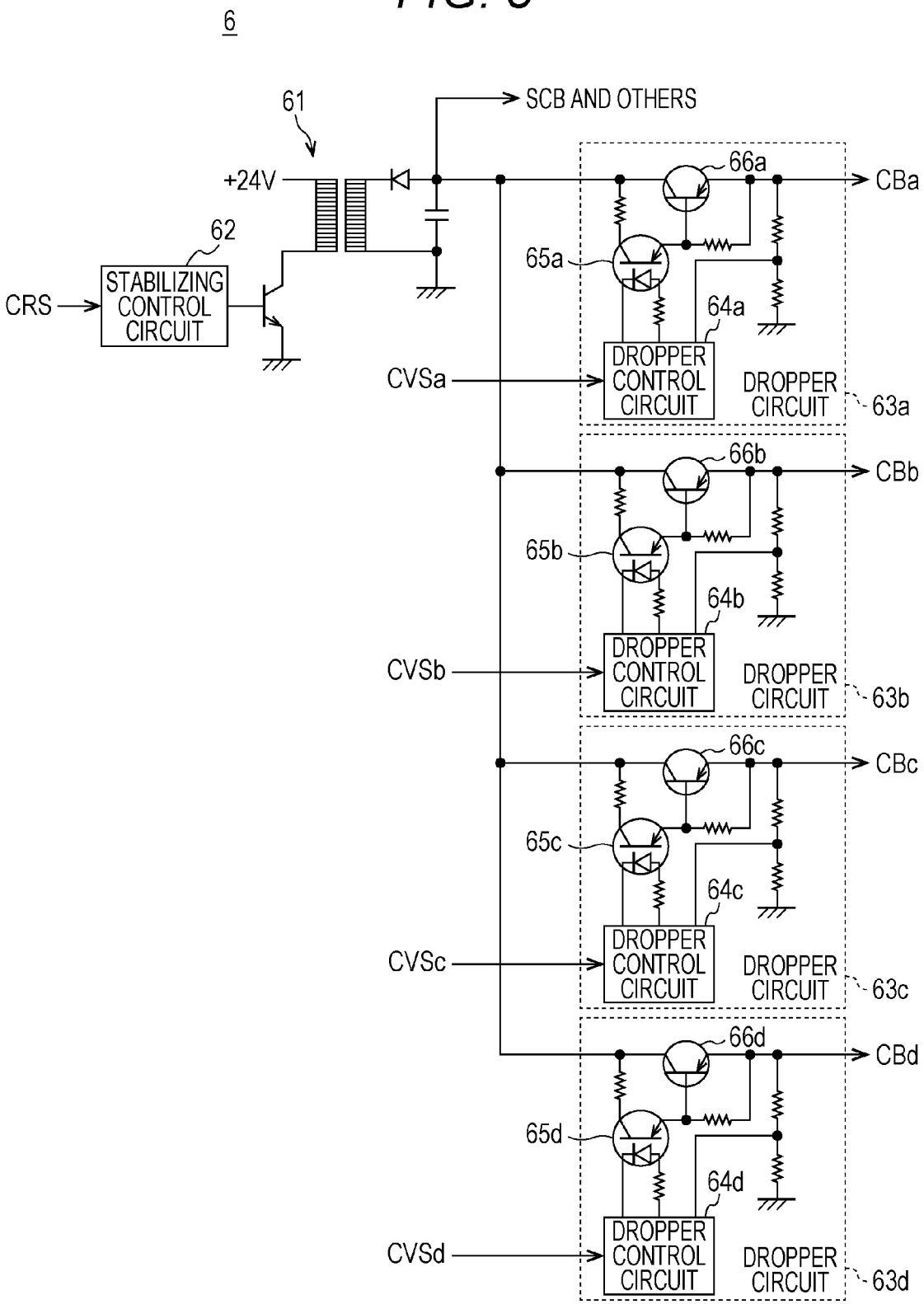
FIG. 3 is a view illustrating a detailed configuration of the high-voltage power supply circuit illustrated in FIG. 2.

Section 3: High-Voltage Power Supply Circuit and Control Circuit in First Embodiment According to the first embodiment, the image forming apparatus 1 includes a high-voltage power supply circuit 6 and the control circuit 7 as illustrated in FIG. 2. The high-voltage power supply circuit 6 includes a single first high-voltage transformer 61, a first stabilizing control circuit 62, and first dropper circuits 63*a* through 63*d* as illustrated in FIG. 3.

The high-voltage transformer 61 is a common transformer used by the charging units 22*a* through 22*d* corresponding to the processing components of the same type. The high-voltage transformer 61 generates a predetermined high voltage based on a voltage applied to the primary side (such as constant voltage of +24V), and outputs the generated high voltage to the secondary side under the control of the stabilizing control circuit 62. The voltage output from the high-voltage transformer 61 is rectified by a diode, smoothed by a capacitor, and supplied to the respective dropper circuits 63*a* through 63*d*.

The stabilizing control circuit 62 turns on a switching transistor when receiving an ON-state first remote signal CRS from the control circuit 7, and drives the high-voltage transformer 61. On the other hand, the stabilizing control circuit 62 turns off the switching transistor when receiving the OFF-state remote signal CRS, and stops driving of the high-voltage transformer 61.

When a voltage setting signal CVSa output from the control circuit 7, and a voltage divided from a charging bias voltage CBa are input to a dropper control circuit 64*a* of the dropper circuit 63*a*, the dropper control circuit 64*a* outputs a signal indicating a difference between the voltage setting signal CVSa and the voltage divided from the charging bias voltage CBa (hereinafter referred to as a difference signal). A PNP-type PD (i.e., a photodiode) of a photo coupler 65*a* emits light in accordance with the input difference signal. A PH (i.e., photo transistor) of the photo coupler 65*a* generates a collector current corresponding to the light input from the PD. When the collector current is supplied from the PH of the photo coupler 65*a* to a base of a PNP-type transistor 66*a*, a voltage is generated between a collector and an emitter of the PNP-type transistor 66*a*. As a result, the charging bias voltage CBa is output from the dropper circuit 63*a*.

The voltage setting signal CVSa is a signal for pulse width modulation (PWM) of the voltage input to the dropper circuit 63*a*. For increasing an absolute value of the charging bias voltage CBa, the voltage setting signal CVSa is set at a large duty ratio. The voltage setting signal CVSa is not limited to a pulsed signal such as a PWM signal, but may be an analog signal.

The voltage between the collector and emitter of the transistor 66*a* is variable according to the amount of the base current in a range not exceeding the maximum rated voltage of the transistor 66*a*. The variable range of the voltage between the collector and the emitter may be narrowed to use a low withstand voltage transistor for the transistor 66*a*.

The dropper circuit 63*a* uses the photo coupler 65*a* to electrically insulate the dropper control circuit 64*a* from high voltage circuits including the high-voltage transformer 61, the transistor 66*a* and others. This structure prevents breakdown of the dropper control circuit 64*a* driven at a low voltage by avoiding influence of the high voltage circuits.

The dropper circuit 63*a* has been chiefly described as a typical example of the dropper circuit. The configurations and operations of the dropper circuits 63*b* through 63*d* are similar to the corresponding configuration and operation of the dropper circuit 63*a*, wherefore the same description concerning the dropper circuits 63*b* through 63*d* is not repeated herein. Individual voltage setting signals CVSa through CVSd are input to the dropper circuits 63*a* through 63*d*, respectively, wherefore the respective voltages between the collectors and the emitters of the transistors 66*a* through 66*d* are appropriately controllable for each under appropriate settings of the base currents of the transistors 66*a* through 66*d*. Accordingly, the charging bias voltages CBb through CBd set to a potential different from the potential of the charging bias voltage CBa are generable.

The voltage output from the high-voltage transformer 61 and supplied to the dropper circuit 63*a* through 63*d* as described herein may be also utilized for generation of a bias voltage SCB for cleaning the secondary transfer roller 4, or for other purposes.

The control circuit 7 outputs driving signals DSj and DSk to the motors 5*j* and 5*k*, respectively, for switching ON-OFF of the driving of the motors 5*j* and 5*k*. The control circuit 7 further outputs, to the motor 5*k*, a speed adjustment signal SSk for specifying that the rotational speed of the motor 5*k* is set to a steady state speed, or to a speed lower than the steady state speed.

Section 4: Operation of Image Forming Apparatus

Operation according to this embodiment is hereinafter detailed with particular reference to FIGS. 4 and 5.

Figure 4:
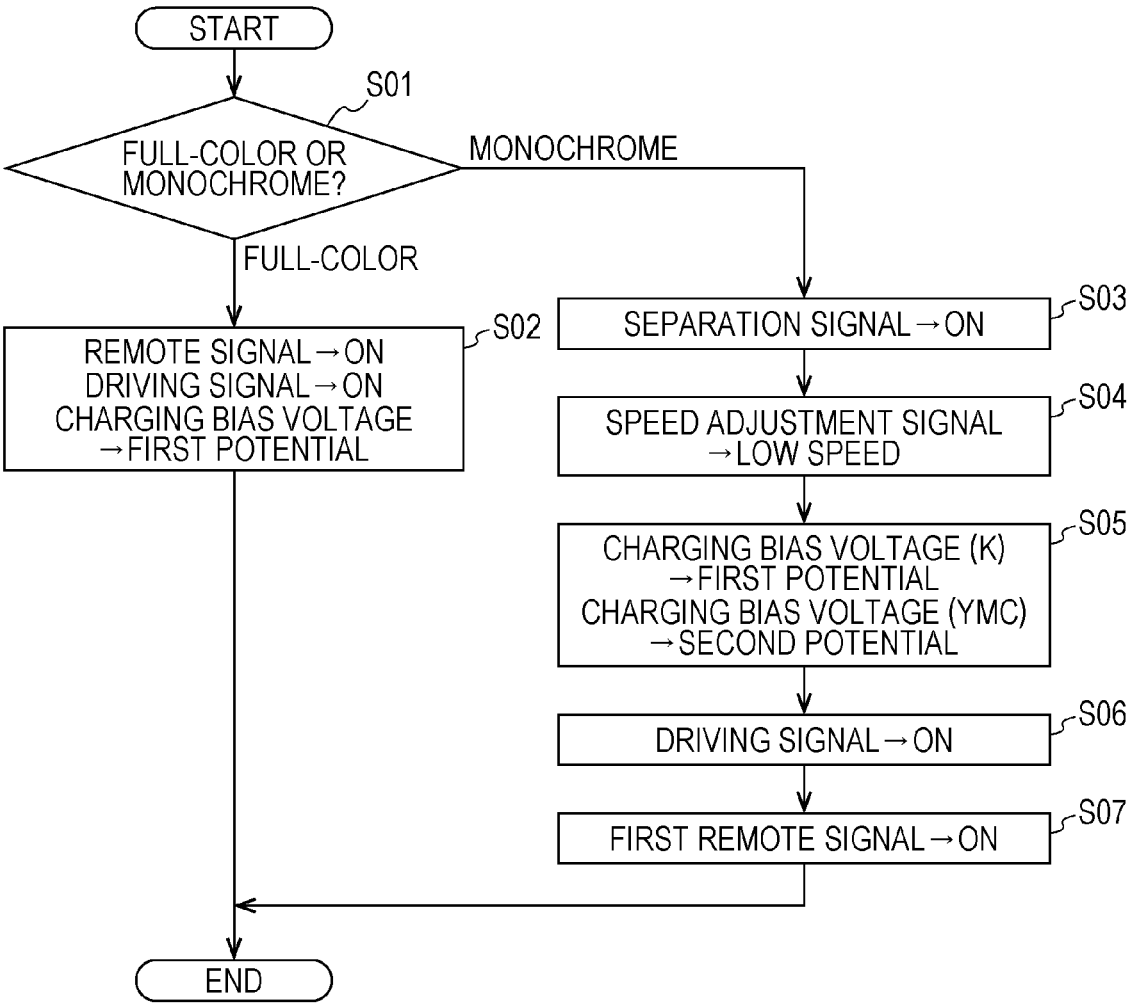
FIG. 4 is a flowchart of the control circuit illustrated in FIG. 2.

When receiving a printing job from a PC (personal computer) or the like connected with the image forming apparatus 1 via a network, the control circuit 7 determines whether the printing job designates the full-color printing mode, or the monochrome printing mode (step S01 in FIG. 4).

When it is determined that the full-color printing mode is designated, the control circuit 7 allows the separation function or mechanism to enter the state illustrated in the upper stage in FIG. 1, and outputs the ON-state remote signal CRS to the stabilizing control circuit 62, the ON-state driving signals DSj and DSk to the motors 5*j* and 5*k*, and the voltage setting signals CVSa through CVSd for generating the charging bias voltages CBa through CBd at a first potential (such as −1600 V) to the dropper circuits 63*a* through 63*d* (step S02). The developing bias voltage, the primary transfer bias voltage, and the secondary transfer bias voltage may be voltages used in a known technology, and therefore are not detailed herein.

Figure 5:
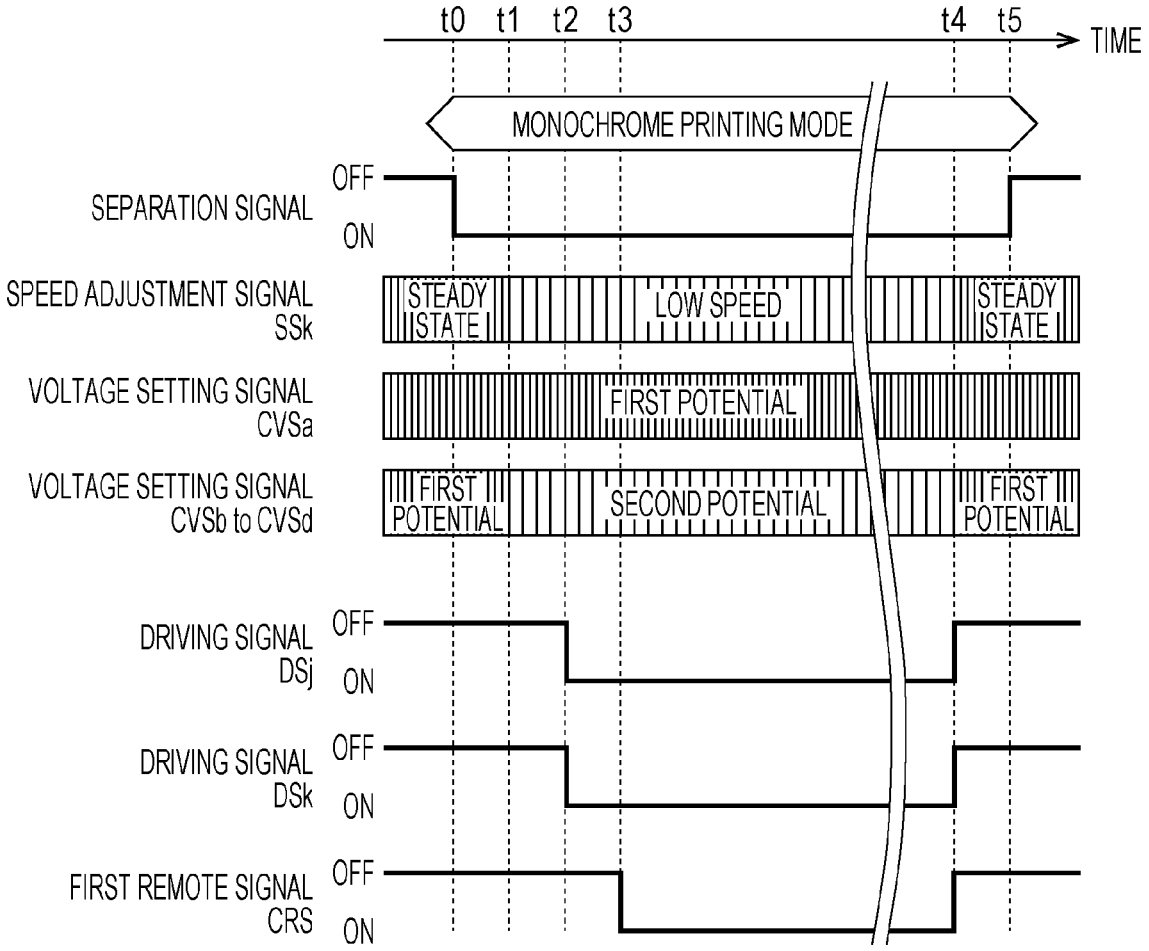
FIG. 5 is a timing chart in the monochrome printing mode illustrated in FIG. 4.

When it is determined that the designated mode is the monochrome printing mode in step S01, the control circuit 7 issues, to the separation function or mechanism, a separation signal for separating the photosensitive drums 21*b* through 21*d* not used in the monochrome printing mode from the intermediate transfer belt 3 at a time t0 in FIG. 5 to allow these photosensitive drums 21*b* through 21*d* to enter the state illustrated in the lower stage in FIG. 1 (step S03).

At a time t1, the speed adjustment signal SSk for setting the rotational speed of the motor 5*k* to a low speed is input to the motor 5*k* (step S04).

At least before the time t1, the voltage setting signal CVSa at a relatively large duty ratio is input to the dropper circuit 63*a*. At the time t1, the voltage setting signals CVSb through CVSd at a relatively small duty ratio are input to the dropper circuit 63*b* through 63*d*, respectively (step S05).

At a time t2 in FIG. 5, the ON-state driving signals DSj and DSk are input to the motors 5*j* and 5*k*, respectively (step S06). In response to this input, the photosensitive drums 21*a* through 21*d* start rotation. When the motors 5*j* and 5*k* come into a steady state, the photosensitive drums 21*b* through 21*d* start rotation at a lower speed than the speed of rotation of the photosensitive drum 21*a*.

At a time t3 in FIG. 5, the ON-state remote signal CRS is input to the stabilizing control circuit 62 (step S07). In response to this input, the charging bias voltages CBa through CBd are output from the dropper circuits 63*a* through 63*d*. The charging bias voltage CBa is set to the first potential (such as −1600 V), while the charging bias voltages CBb through CBd are set to a second potential (such as −800V). The second potential has an absolute value less than that of the first potential. It is more preferable that the second potential set in this case has a smallest possible absolute value within a range of output from the dropper circuits 63*b* through 63*d*. The charging bias voltage CBb through CBd are maintained substantially at the second potential from the start till the end of the monochrome printing mode.

The developing bias voltage, the primary transfer bias voltage, and the secondary transfer bias voltage may be voltages used in a known technology, and therefore are not detailed herein.

At the time of the end of the monochrome printing mode, the speed adjustment signal SSk is set to a high speed, the voltage setting signals CVSb through CVSd are set to a high duty ratio, and the driving signals DSj and DSk and the remote signal CRS are set to the OFF-state at a time t4, for example. At a time t5, the separation signal is set to the OFF state.

Section 5: Advantageous Effects of Image Forming Apparatus

According to the image forming apparatus 1, the high-voltage transformer 61 is used as a common transformer for all the colors of Y, M, C, and K as described above. After completion of the processes in steps S03 through S07 described above, the image forming apparatus 1 starts actual printing in the monochrome printing mode. As well known, the life of a photosensitive drum is dependent on the number of rotations. According to this embodiment, the number of rotations of the respective photosensitive drums 21*b* through 21*d* not used in the monochrome printing mode is decreased to avoid shortening of the lives of the photosensitive drums 21*b* through 21*d*. When the high-voltage transformer 61 is used in common, the charging bias voltages CBb through CBd are output based on the specifications of the transistors 66*a* through 66*d* even in the monochrome printing mode. However, each absolute value of the charging bias voltages CBb through CBd is set to a value less than the absolute value of the first potential, wherefore each charge amount of the photosensitive drums 21*b* through 21*d* becomes less than the corresponding charge amount generated when the first potential is applied. Accordingly, image deterioration called an image memory is avoidable.

It is preferable that the second potential is set to the lower limit of the absolute value within the range of output from the dropper circuits 63*b* through 63*d*. In this case, reduction of the image memory is achievable in the most effective manner.

The charging bias voltages CBb trough CBd are maintained at a constant potential during the monochrome printing mode as described above. Accordingly, unevenness of the charging potential of the photosensitive drums 21*b* through 21*d* decreases.

Section 6: High-Voltage Power Supply Circuit and Control Circuit in Second Embodiment The image forming apparatus 1 according to a second embodiment is different from the image forming apparatus 1 in the first embodiment in that the high-voltage power supply circuit 6 further includes a configuration associated with the developing units 24*a* through 24*d* as illustrated in FIG. 6. Other configurations are similar to the corresponding configurations in the first embodiment. Configurations in FIG. 6 similar to the corresponding configurations illustrated in FIG. 2 have been given similar reference numbers, and the same explanation is not repeated herein.

Figure 7:
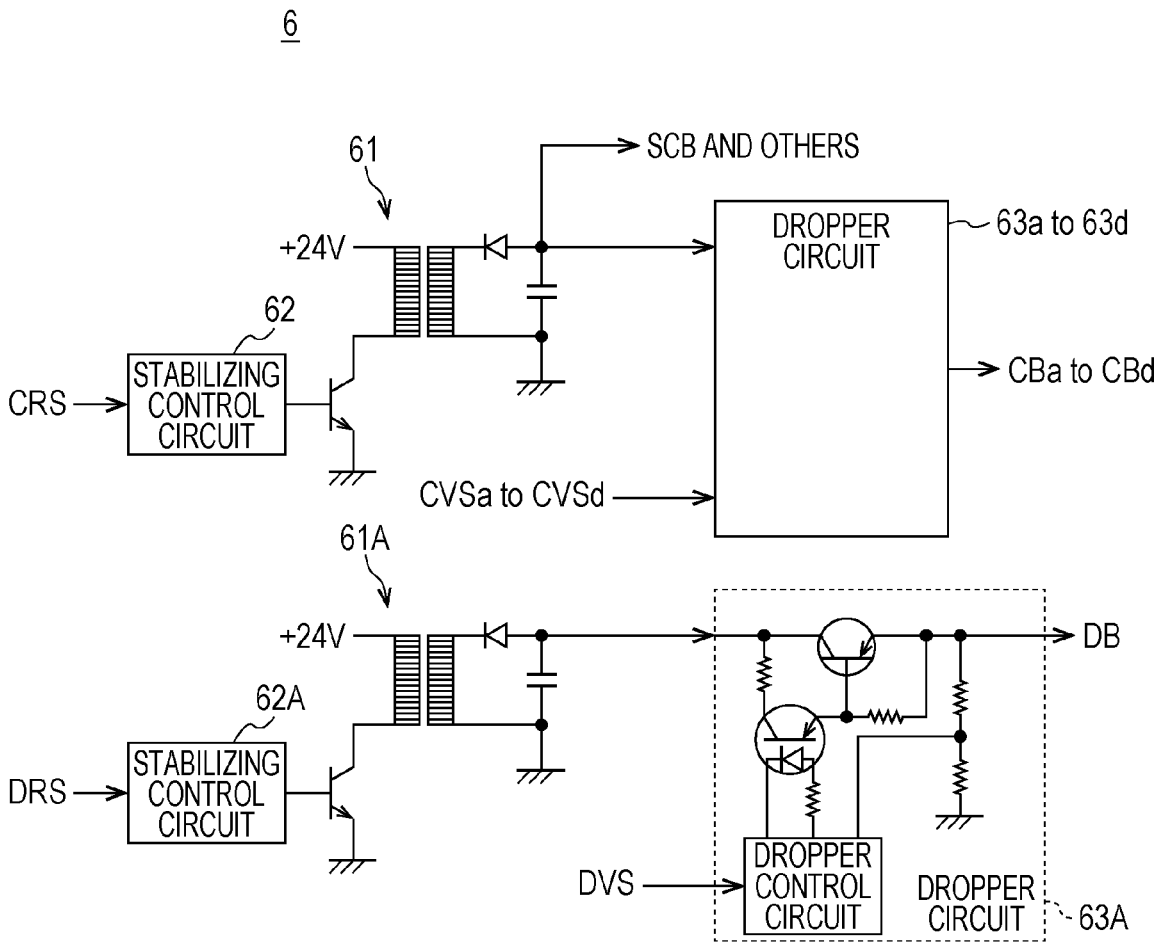
FIG. 7 is a view illustrating a detailed configuration of the high-voltage power supply circuit illustrated in FIG. 6.

As illustrated in FIG. 7, the high-voltage power supply circuit 6 includes a second high-voltage transformer 61A, a second stabilizing control circuit 62A, and a second dropper circuit 63A, in addition to the configuration illustrated in FIG. 3.

The high-voltage transformer 61A is a common transformer used by the developing units 24*a* through 24*d* corresponding to processing components of the same type. The high-voltage transformer 61A generates a predetermined high voltage, and supplies the generated high voltage to the dropper circuit 63A under the control of the stabilizing control circuit 62A. The stabilizing control circuit 62A turns on or off switching transistors in response to a second remote signal DRS received from the control circuit 7 to drive or stop the high-voltage transformer 61A.

The dropper circuit 63A has a configuration similar to the configuration of the dropper circuit 63*a* or the like, and generates and outputs a developing bias voltage DB based on an input voltage setting signal DVS.

Section 7: Operation of Image Forming Apparatus

Figure 8:
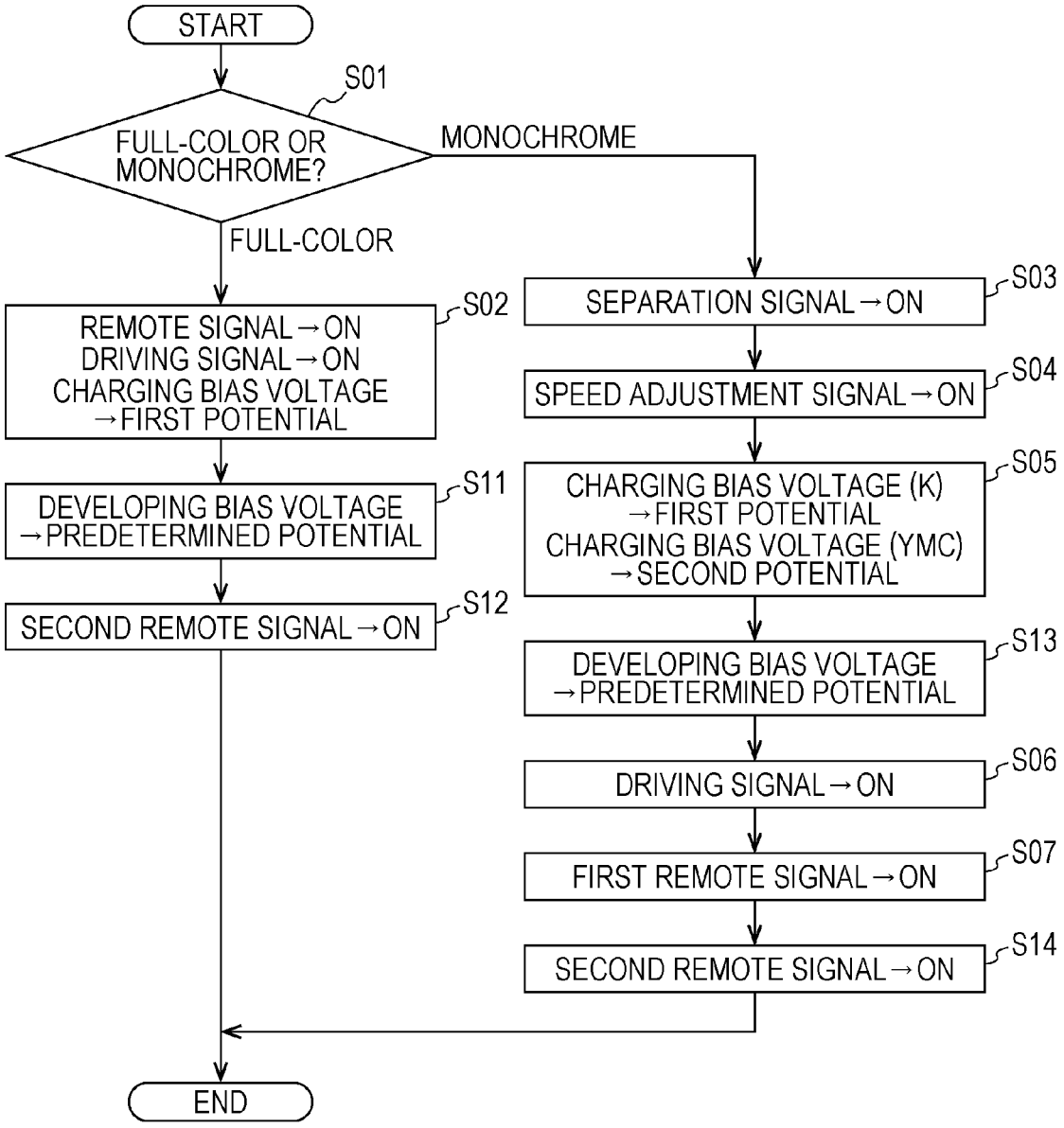
FIG. 8 is a flowchart of the control circuit illustrated in FIG. 6.
Figure 9:
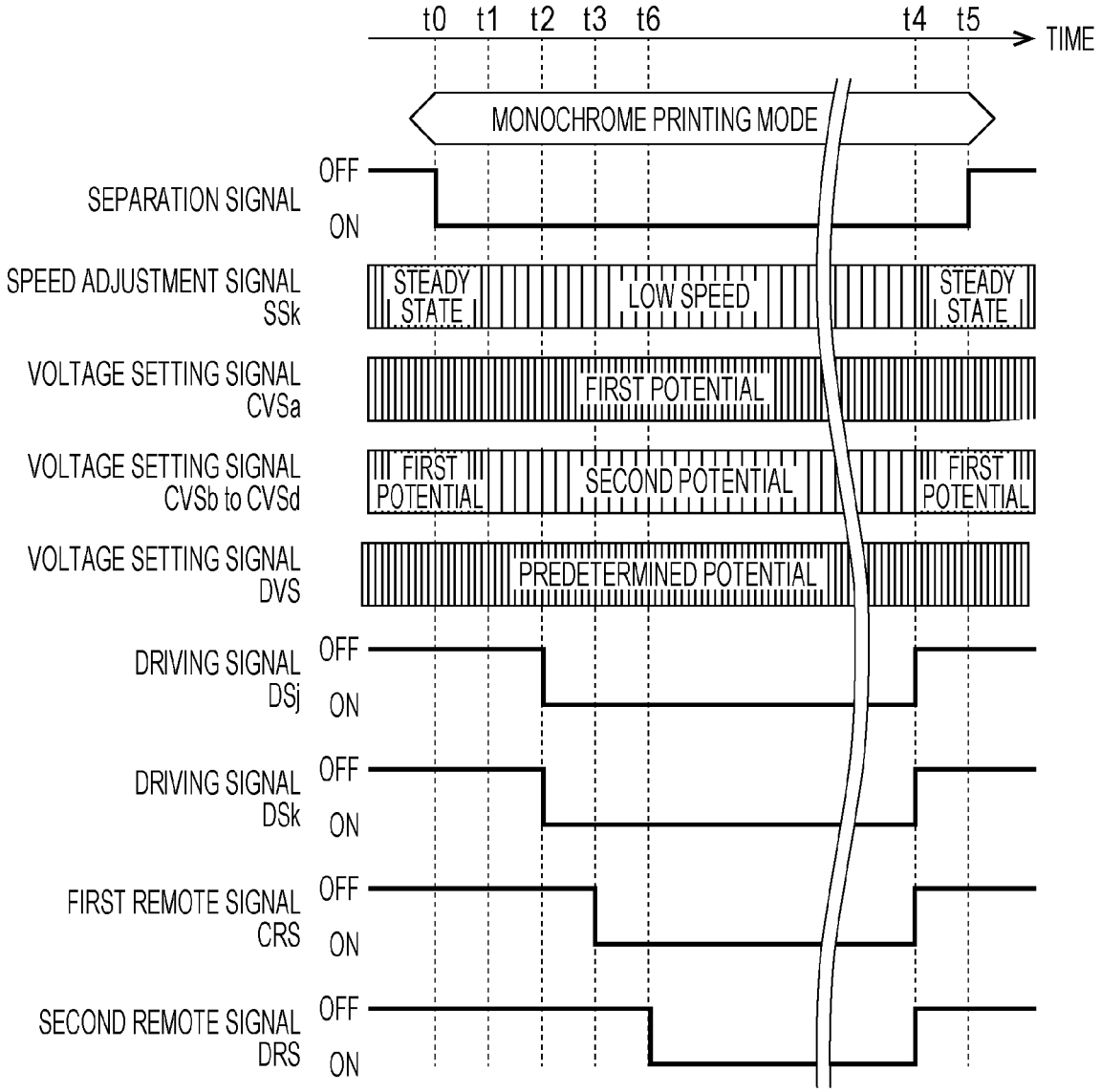
FIG. 9 is a timing chart in the monochrome printing mode illustrated in FIG. 8.

Operation according to this embodiment is hereinafter described with particular reference to FIGS. 8 and 9. FIG. 8 includes steps S11 through S14 in addition to the respective steps shown in FIG. 4. There is no difference between these figures except for the additional steps. Steps in FIG. 8 similar to the corresponding steps in FIG. 4 have been given similar step numbers, and the same explanation is not repeated herein. FIG. 9 includes the voltage setting signal DVS in addition to the signals illustrated in FIG. 5. There is no difference between these sequence diagrams except for the additional signal. The signals shown in FIG. 5 and also included in FIG. 9 are not repeatedly explained herein.

In the full-color printing mode, the control circuit 7 having executed the process in step S02 outputs the voltage setting signal DVS to the dropper circuit 63A to generate the developing bias voltage DB at a predetermined potential (step S11). At a time t6 in FIG. 9, the ON-state remote signal DRS is input to the stabilizing control circuit 62A (step S12). As a result, the developing bias voltage DB is output from the dropper circuit 63A.

On the other hand, the control circuit 7 sequentially executes the processes steps S03 through S05 in the monochrome printing mode. At least before the time t6, the control circuit 7 outputs the voltage setting signal DVS to the dropper circuit 63A (step S13). As a result, the developing bias voltage DB at a predetermined potential is applied from the dropper circuit 63A to the developing units 24*a* through 24*d*.

The control circuit 7 executes steps S06 and S07, and then outputs the ON-state remote signal DRS to the stabilizing control circuit 62A (step S14). In response to this output, the dropper circuit 63A outputs the developing bias voltage DB.

The primary transfer bias voltage and the secondary transfer bias voltages may be voltages used in a known technology, and therefore are not detailed herein.

Section 8: Advantageous Effects in Second Embodiment

According to the second embodiment, advantageous effects similar to the advantageous effects of the first embodiment are offered in the monochrome printing mode. In addition, the photosensitive drums 21*b* through 21*d* not used in the monochrome printing mode continues rotation at a uniform speed during the monochrome printing based on the process in step S06. Accordingly, uneven film reduction of the photosensitive drums 21*b* through 21*d* caused by the developing bias voltage DB is avoidable.

Section 9: High-Voltage Power Supply Circuit and Control Circuit in Third Embodiment As illustrated in FIG. 10, the image forming apparatus 1 according to a third embodiment is different from the image forming apparatus 1 in the first embodiment in that the high-voltage power supply circuit 6 includes a configuration associated with the primary transfer rollers 25*a* through 25*d* instead of the configuration associated with the charging units 22*a* through 22*d*. Other configurations are similar to the corresponding configurations in the first embodiment. Configurations in FIG. 10 similar to the corresponding configurations illustrated in FIG. 2 have been given similar reference numbers, and the same explanation is not repeated herein.

Figure 11:
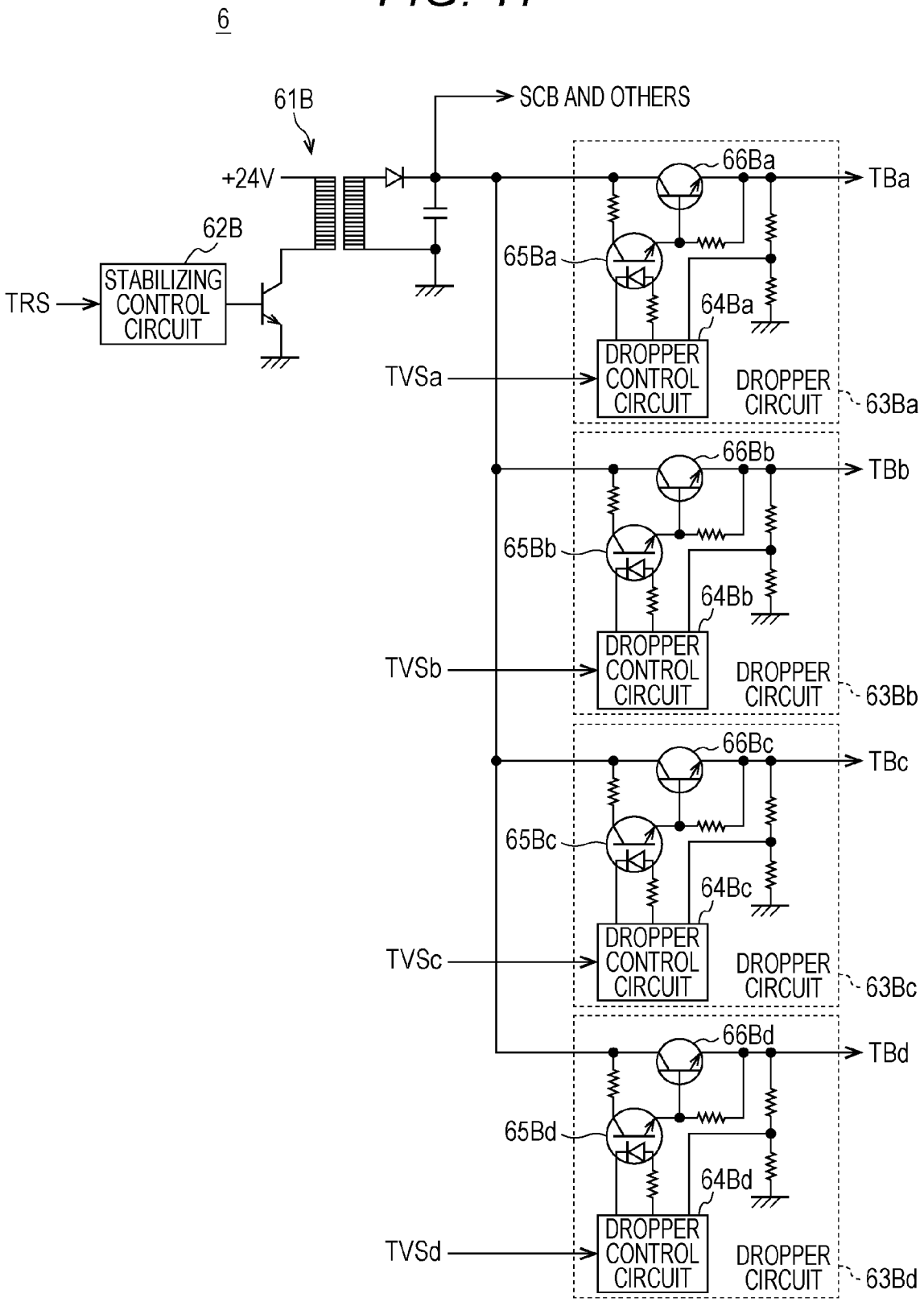
FIG. 11 is a view illustrating a detailed configuration of the high-voltage power supply circuit illustrated in FIG. 10.

As illustrated in FIG. 11, the high-voltage power supply circuit 6 includes a single third high-voltage transformer 61B, a third stabilizing control circuit 62B, and third dropper circuits 63Ba through 63Bd.

The high-voltage transformer 61B is a common transformer used by the primary transfer rollers 25*a* through 25*d* corresponding to processing components of the same type. The high-voltage transformer 61B generates and outputs a predetermined high voltage under the control of the stabilizing control circuit 62B. The voltage output from the high-voltage transformer 61B is rectified and smoothed, and supplied to the respective dropper circuits 63Ba through 63Bd.

The stabilizing control circuit 62B turns on or off switching transistors based on a third remote signal TRS generated from the control circuit 7 to drive or stop the high-voltage transformer 61B.

The dropper circuits 63Ba through 63Bd are different from the dropper circuits 63*a* through 63*d* in that the primary transfer bias voltages to be generated are positive primary bias voltages TBa through TBd. Accordingly, the dropper circuits 63Ba through 63Bd are different from the dropper circuits 63*a* through 63*d* in the following points.

(1) Directions of anode and cathode of a rectifying element are reversed.

(2) NPN type transistors are used.

(3) NPN type PHs are used.

According to the third embodiment, the high-voltage power supply circuit 6 is capable of generating the transfer bias voltages TBa through TBd at the first potential (such as 2800 V) in the full-color printing mode. On the other hand, the high-voltage power supply circuit 6 generates the transfer bias voltage TBa at the first potential, and the charging bias voltages TBb through TBd at a second potential having an absolute value (such as 2000 V) less than the absolute value of the first potential in the monochrome printing mode. It is preferable that the absolute value of the second potential is set to the lower limit within a range of output from the dropper circuits 63Bb through 63Bd.

Section 10: Advantageous Effects in Third Embodiment

Similarly to the second embodiment, the photosensitive drums 21*b* through 21*d* not used in the monochrome printing mode continue rotation at a uniform speed during the monochrome printing mode in the third embodiment. Accordingly, unevenness of film reduction of the photosensitive drums 21*b* through 21*d* is avoidable similarly to the second embodiment.

Section 11: Setting of Photosensitive Drum Angular Speed in Monochrome Printing Mode In the respective embodiments described herein, it is preferable that the angular speed of the photosensitive drums 21*b* through 21*d* is set based on tables in Table 1 and Table 2 retained in the control circuit 7 beforehand.

TABLE 1

TABLE OF REFERENCE NUMBER OF SHEETS

| | | SIZE AND DIRECTION OF PRINTING MEDIUM | | |
|---|---|---|---|---|
| SYSTEM SPEED | PRINTING SPEED | K1 (A3 PORTRAIT SIZE) | K1 (A4 PORTRAIT SIZE) | K1 (A4 LANDSCAPE SIZE) |
| 300 mm/s | 60 ppm | 3 (19.6 mm/s) | 4 (19.3 mm/s) | 5 (20.0 mm/s) |
| 200 mm/s | 40 ppm | 2 (20.2 mm/s) | 3 (17.5 mm/s) | 4 (16.9 mm/s) |
| 100 mm/s | 20 ppm | 1 (22.4 mm/s) | 2 (13.7 mm/s) | 2 (18.3 mm/s) |

A table of reference number of sheets in Table 1 shows a reference printing number of sheets K1 produced by the photosensitive drum 21*a* for printing a monochrome image during one rotation of the photosensitive drums 21*b* through 21*d* for each combination of the size and speed of the printing medium and a system speed. An angular speed is shown in parentheses immediately below the corresponding reference printing number of sheets K1.

The system speed is a conveyance speed of the printing medium. A printing speed is correlated with the system speed, indicating the printing number of sheets of the printing medium per unit time (such as one minute).

TABLE 2

TABLE OF SECOND ANGULAR SPEED

| | | | DESIGNATED NUMBER OF SHEETS BY PRINTING JOB | | | |
|---|---|---|---|---|---|---|
| SYSTEM SPEED | PRINTING SPEED | SIZE AND DIRECTION | K3 (FOR 1 SHEET) | K3 (FOR 2 SHEETS) | K3 (FOR 3 SHEETS) | K3 (FOR 4 SHEETS) |
| 300 mm/s | 60 ppm | A3 PORTRAIT SIZE | 67.3 mm/s | 30.4 mm/s | | |
| | | A4 PORTRAIT SIZE | 95.2 mm/s | 41.2 mm/s | 26.3 mm/s | |
| | | A4 LANDSCAPE SIZE | 134.6 mm/s | 55.3 mm/s | 34.8 mm/s | 25.4 mm/s |
| 200 mm/s | 40 ppm | A3 PORTRAIT SIZE | 44.9 mm/s | | — | — |
| | | A4 PORTRAIT SIZE | 63.5 mm/s | 27.5 mm/s | | — |
| | | A4 LANDSCAPE SIZE | 89.8 mm/s | 36.8 mm/s | 23.1 mm/s | |
| 100 mm/s | 20 ppm | A4 PORTRAIT SIZE | 31.7 mm/s | | — | — |
| | | A4 LANDSCAPE SIZE | 44.9 mm/s | | — | — |

A table of second angular speed in Table 2 shows an angular speed K3 of the photosensitive drums 21*b* through 21*d* for each combination of the actual printing number of sheets designated by a printing job and the size and direction of the printing medium.

A process for setting the angular speed of the photosensitive drums 21*a* through 21*d* based on Table 1 and Table 2 is hereinafter described with reference to FIGS. 12 and 13. This setting process illustrated in FIGS. 12 and 13 is executed immediately after the printing mode is determined as the monochrome printing mode in step S01 described above.

Figure 12:
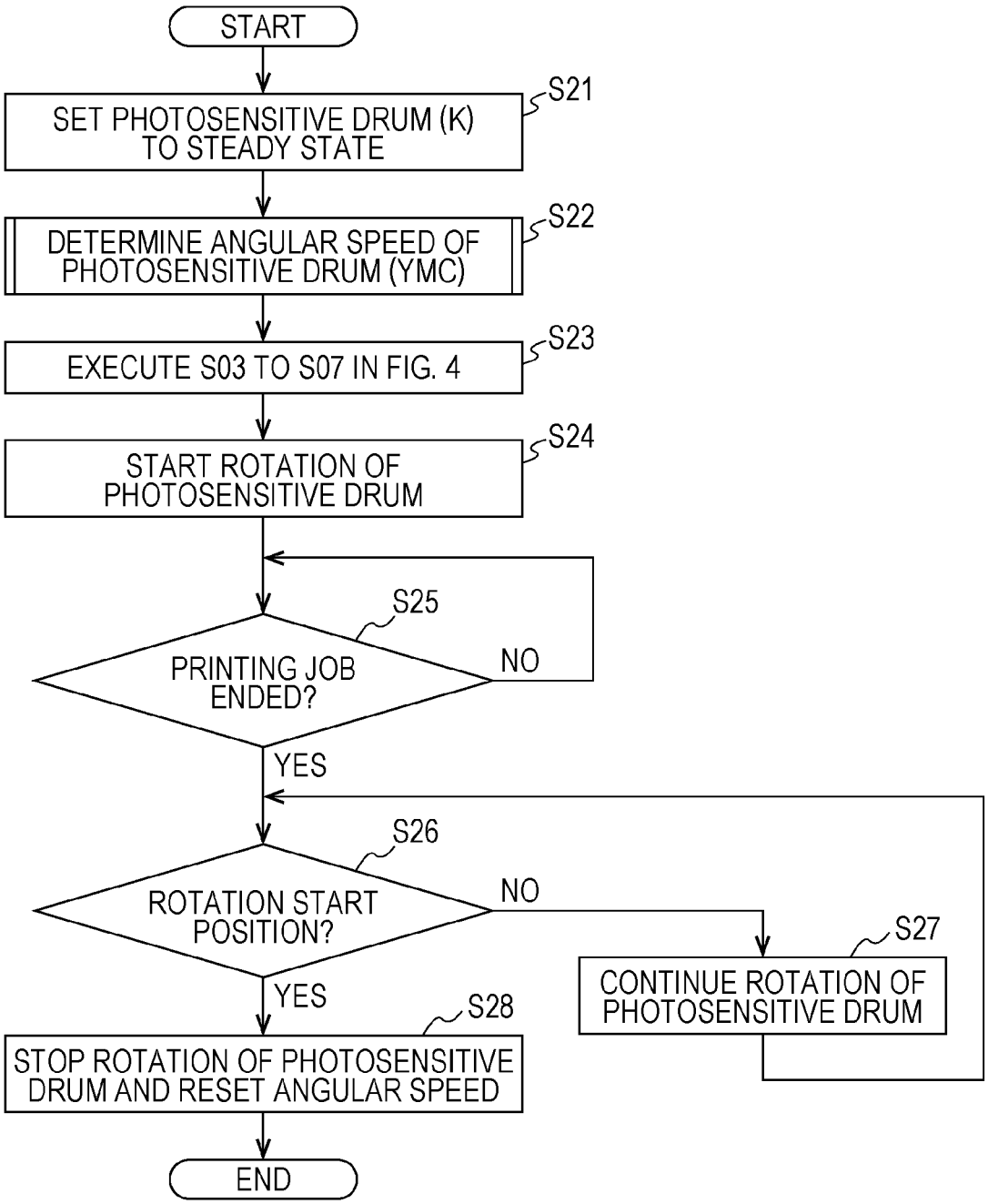
FIG. 12 is a flowchart illustrating a process for setting an angular speed.

Initially, the control circuit 7 sets the angular speed of the photosensitive drum 21*a* to the system speed, for example, as illustrated in FIG. 12 (step S21). Then, the control circuit 7 determines the angular speed of the photosensitive drums 21*b* through 21*d* in accordance with a flowchart illustrated in FIG. 13 (step S22).

Figure 13:
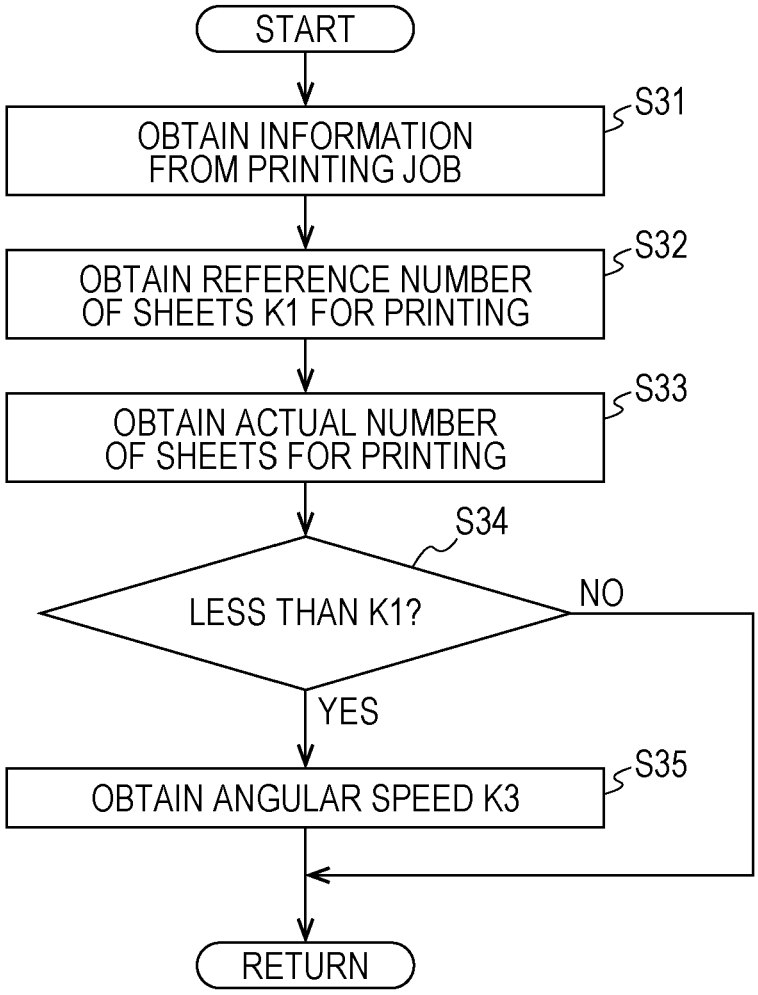
FIG. 13 is a flowchart illustrating a detailed process executed in step S22 in FIG. 12.

In FIG. 13, the control circuit 7 obtains information indicating the system speed, the printing speed (printing number of sheets per unit time), and the size and direction of the printing medium based on a current printing job (step S31), and selects the reference printing number of sheets K1 corresponding to information obtained in step S25, and the angular speed corresponding to the selected reference printing number of sheets K1 based on Table 1 (step S32).

Subsequently, the control circuit 7 obtains the actual printing number of sheets based on the current printing job (step S33), and determines whether or not the actual printing number of sheets is less than the reference printing number of sheets K1 (step S34).

When "Yes" in step S34, the control circuit 7 selects the angular speed K3 corresponding to the system speed, the size and direction of the printing medium, and the actual printing number of sheets from Table 2 (step S35).

When "No" in step S34 or after completion of step S35, the control circuit 7 shifts from the flowchart in FIG. 13, and executes the processes corresponding to steps S03 through S07 in FIG. 4 (step S23). As a result, the respective photosensitive drums 21*a* through 21*d* start rotation (step S24).

When the printing job is completed (step S25), the control circuit 7 determines whether or not the photosensitive drums 21*b* through 21*d* have reached rotation start positions (step S26), and allows the photosensitive drums 21*b* through 21*d* to continue rotation until "Yes" in step S26 (step S27). When "Yes" in step S26, the control circuit 7 stops rotation of the photosensitive drums 21*b* through 21*d*, and resets the angular speed (step S28). After this step, the process in FIG. 12 ends.

Section 12: Advantageous Effects of Angular Speed Setting

When the printing job designates the system speed as 300 mm/s, the size and direction of the printing medium as A3 portrait size, and the printing number of sheets as 8 sheets in the foregoing process, for example, K1=3 and 19.6 mm/s as the angular speed of the photosensitive drums 21*b* through 21*d* are selected from Table 1 in step S32. In this case, the angular speed of the photosensitive drums 21*b* through 21*d* is set such that the photosensitive drums 21*b* through 21*d* rotate once for three sheets of monochrome printing. In other words, the photosensitive drums 21*b* through 21*d* rotate three times in total from the start till the end of the monochrome printing. In this case, the photosensitive drums 21*b* through 21*d* rotate once for two sheets of monochrome printing in an actual situation during the last one rotation of the photosensitive drums 21*b* through 21*d*. This manner of the last rotation is not caused by a change of the angular speed of the photosensitive drums 21*b* through 21*d*. The photosensitive drums 21*b* through 21*d* rotate at a uniform speed. More specifically, the photosensitive drums 21*b* through 21*d* execute the last one-third rotation during a period corresponding to monochrome printing for a ninth sheet not to be actually printed by the processes in steps S27 and S28 to complete three rotations. This manner of rotation achieves substantial alignment between the start position and the stop position of the photosensitive drums 21*b* through 21*d* in the low-speed rotation.

On the other hand, in step S35, the angular speed K3 is selected from Table 2 such that the photosensitive drums 21*b* through 21*d* rotate once during the monochrome printing for the actual number of sheets. This manner of rotation achieves substantial alignment between the start position and the stop position of the photosensitive drums 21*b* through 21*d* in the low-speed rotation, similarly to the foregoing case.

As described above, the photosensitive drums 21*b* through 21*d* rotate an integer number of times during the period of the monochrome printing mode based on the setting of the angular speed of the photosensitive drums 21*b* through 21*d* as in the manner illustrated in FIGS. 12 and 13. More specifically, this structure achieves substantial alignment between a position on each surface of the position of the photosensitive drums 21*b* through 21*d* at the start of supply of power from the high-voltage power supply circuit 6, and a position thereon at the end of supply of power. Accordingly, unevenness of charging and film reduction of the photosensitive drums 21*b* through 21*d* further decreases.

Section 13: Multi-Mode Sequence

The image forming apparatus 1 continuously receives a plurality of printing jobs from a PC connected with the image forming apparatus 1 via a network. In this case, the control circuit 7 is required to execute the monochrome printing mode immediately after completion of the full-color printing mode, or the full-color printing mode immediately after completion of the monochrome printing mode in some cases.

Figure 14:
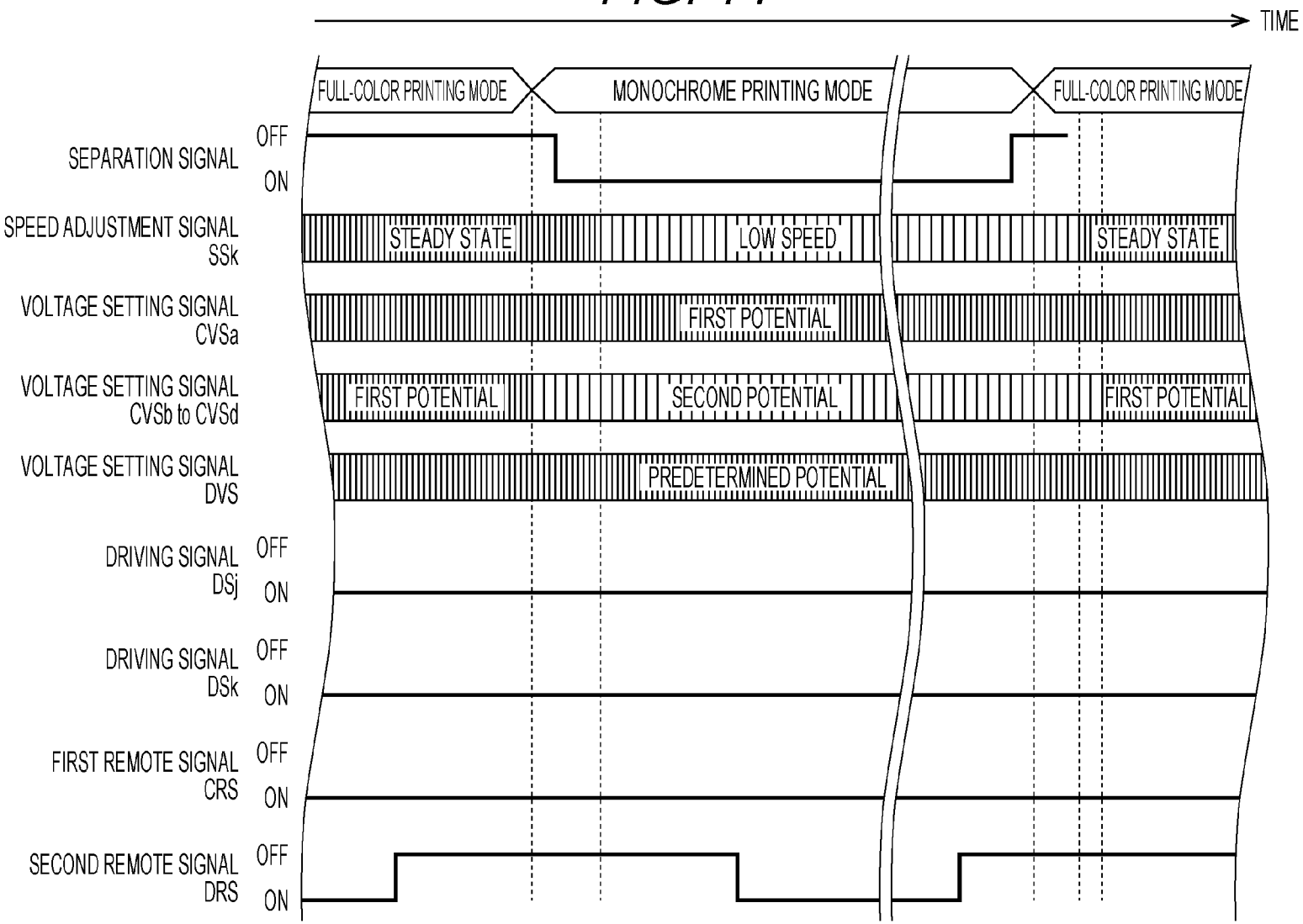
FIG. 14 is a timing chart illustrating the full-color printing mode, the monochrome printing mode, and the full-color printing mode performed in this order.

When the monochrome printing mode is executed immediately after completion of the full-color printing mode, it is preferable that the angular speed of the photosensitive drums 21*b* through 21*c* is reduced before formation of a monochrome image by the photosensitive drum. 21*a* as illustrated in FIG. 14. This method avoids shortening of the lives of the photosensitive drums 21*b* through 21*d*.

Figure 15:
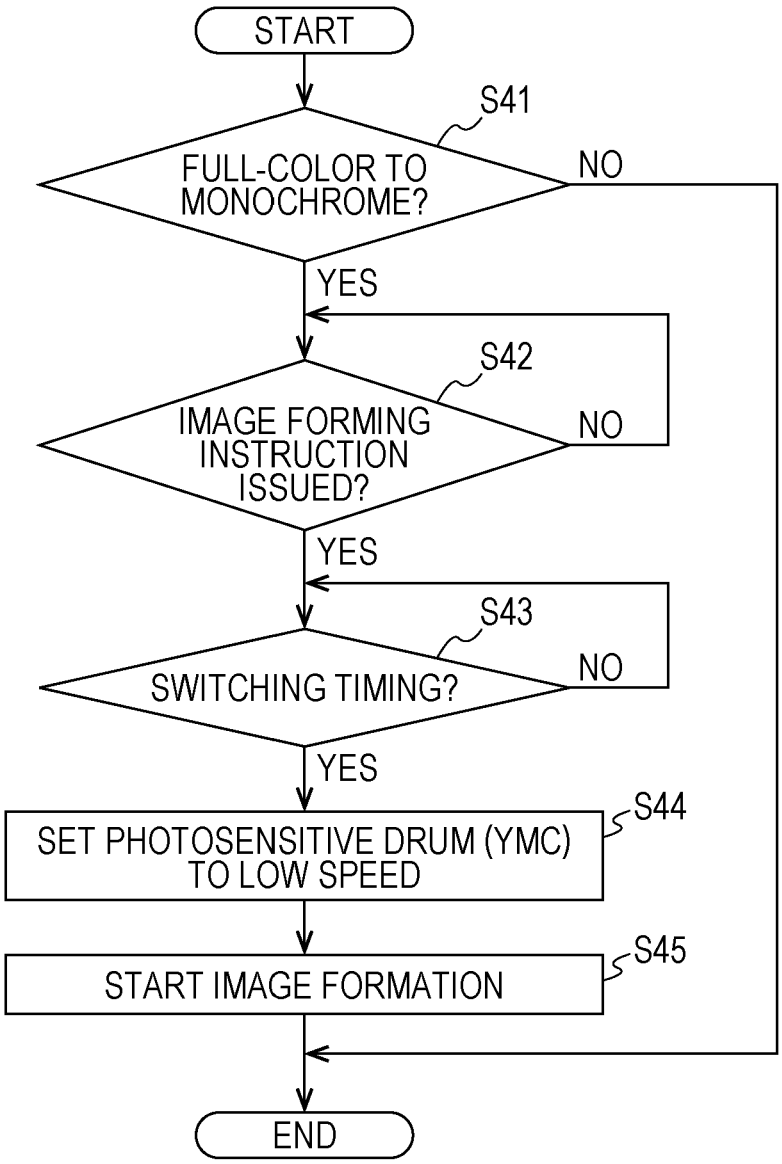
FIG. 15 is a flowchart illustrating procedures for angular switching of an angular speed of a photosensitive drum at the time of switching to the monochrome printing mode.

Switching of the angular speed of the photosensitive drums 21*b* through 21*d* is more specifically described. Before execution of a printing job accumulated in the image forming apparatus 1, the control circuit 7 determines whether or not switching is needed from the full-color printing mode to the monochrome printing mode (step S41 in FIG. 15).

In case of "Yes", the control circuit 7 reduces the angular speed of the photosensitive drums 21*b* through 21*d* (step S44) based on the speed adjustment signal SSk when the current time is a time for switching the angular speed of the photosensitive drums 21*b* through 21*d* to a low speed (step S43) after issue of an instruction for forming a monochrome image (step S42). As a result, formation of a monochrome image starts (step S45).

It is preferable that the potential of the charging bias voltages CBb through CBd is set to the second potential before formation of the monochrome image by the photosensitive drum 21*a* as illustrated in FIG. 14.

Figure 16:
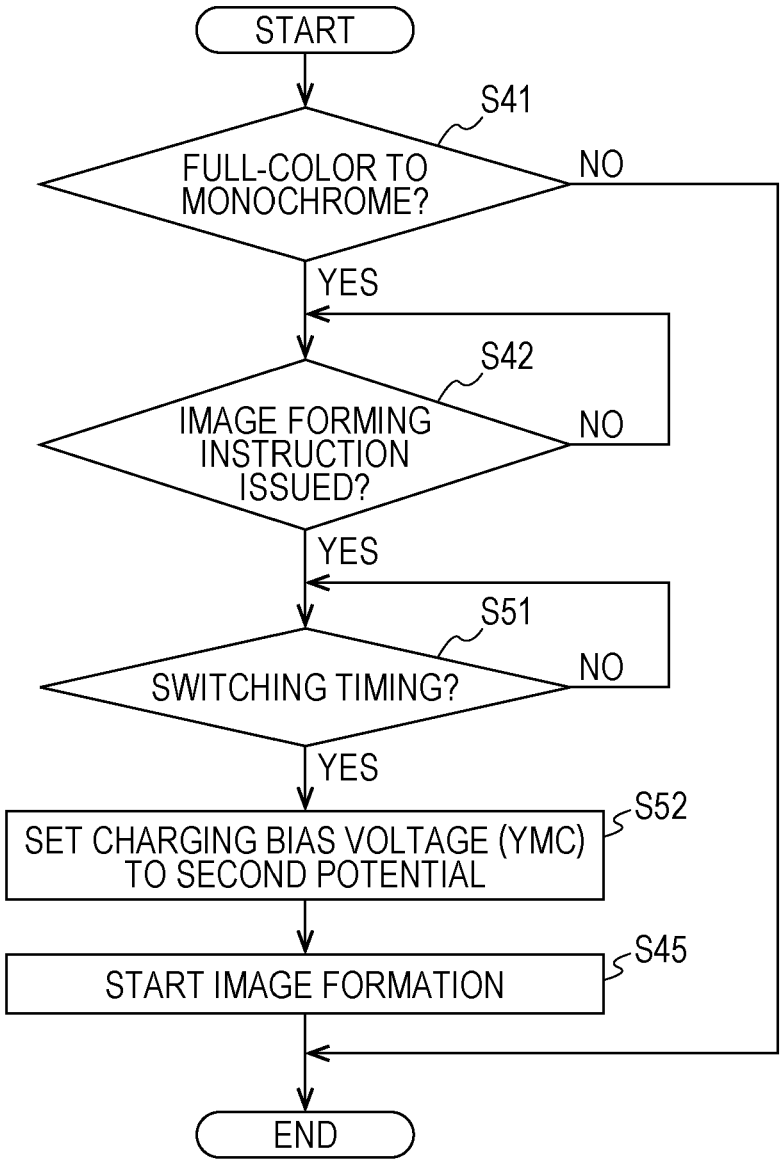
FIG. 16 is a flowchart illustrating procedures for potential switching of a charging bias voltage at the time of switching to the monochrome printing mode.

A process for realizing this potential setting of the charging bias voltages CBb through CBd is more specifically described with reference to FIG. 16. FIG. 16 is different from FIG. 15 in that steps S51 and S52 are executed instead of steps S43 and S44. There is no difference between these flowcharts except for the different steps. Steps in FIG. 16 similar to the corresponding steps in FIG. 15 have been given similar step numbers, and the same explanation is not repeated herein.

After step S42, the control circuit 7 switches the potential of the charging bias voltages CBb through CBd to the second potential (step S52) based on the voltage setting signals CVSb through CVSd when the current time is a time for switching the potential of the charging bias voltages CBb through CBd to the second potential (step S51). Subsequently, formation of a monochrome image starts (step S45).

It is further preferable that, before formation of the monochrome image by the photosensitive drum 21*a*, the potential of the charging bias voltages CBb through CBd is initially set to the second potential, whereafter the angular speed of the photosensitive drums 21*b* through 21*d* is reduced as illustrated in FIG. 14. In this case, unevenness of charging or film reduction of the photosensitive drums 21*b* through 21*d* further decreases.

Figure 17:
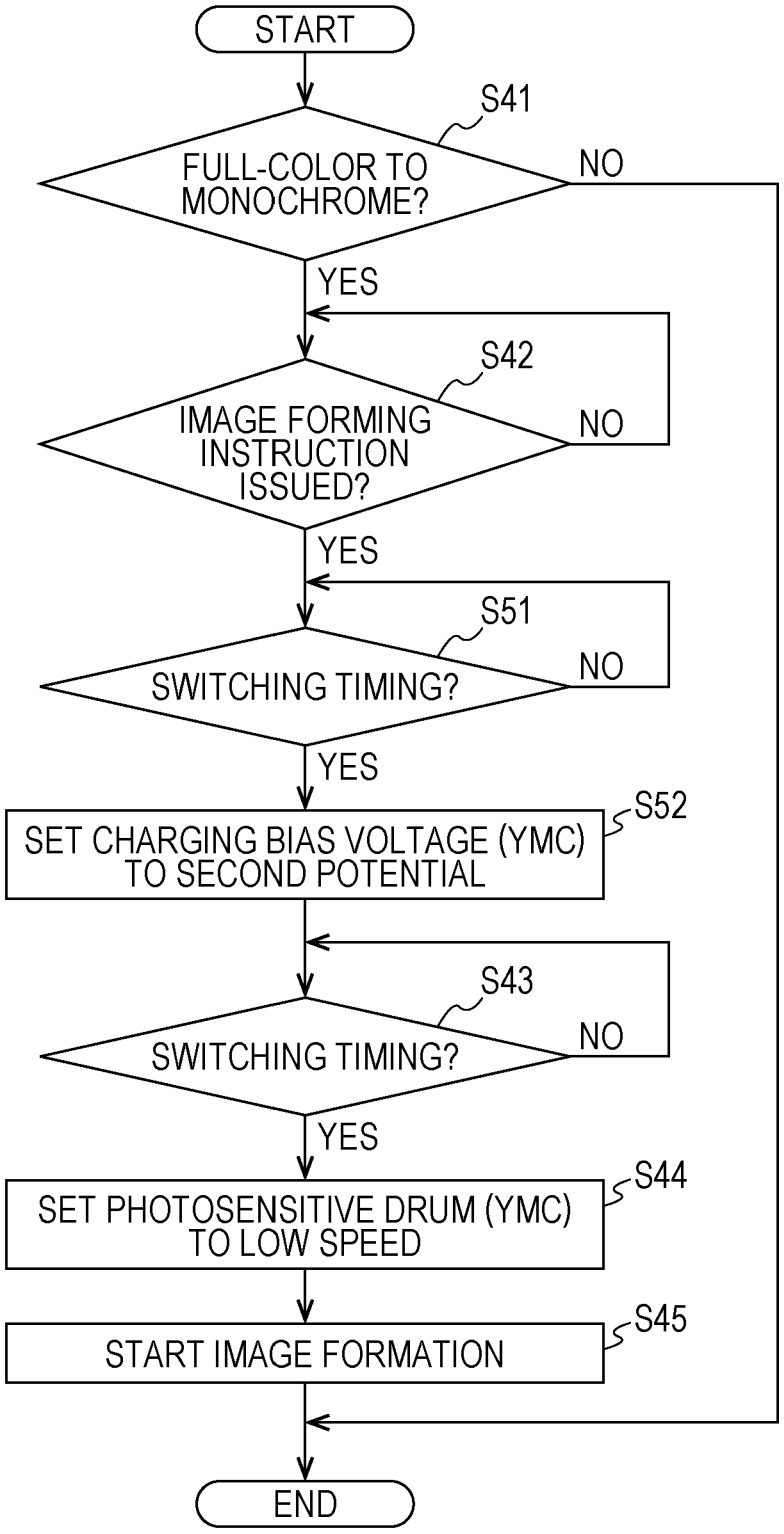
FIG. 17 is a flowchart illustrating procedures for angular speed switching of the photosensitive drum and potential switching of the charging bias voltage at the time of switching to the monochrome printing mode.

A combination process for setting the angular speed of the photosensitive drums 21*b* through 21*d* and for setting the potential of the charging bias voltages CBb through CBd is more specifically described with reference to FIG. 17. FIG. 17 is different from FIG. 16 in that steps S43 and S44 are executed between steps S52 and S45. There is no difference between these flowcharts except for the additional steps. Steps in FIG. 17 similar to the corresponding steps in FIG. 16 have been given similar step numbers, and the same explanation is not repeated herein.

When the full-color printing mode is executed immediately after completion of the monochrome printing mode, it is preferable that the angular speed of the photosensitive drums 21*b* through 21*d* is returned to the steady state speed before formation of a full-color image as illustrated in FIG. 14.

Figure 18:
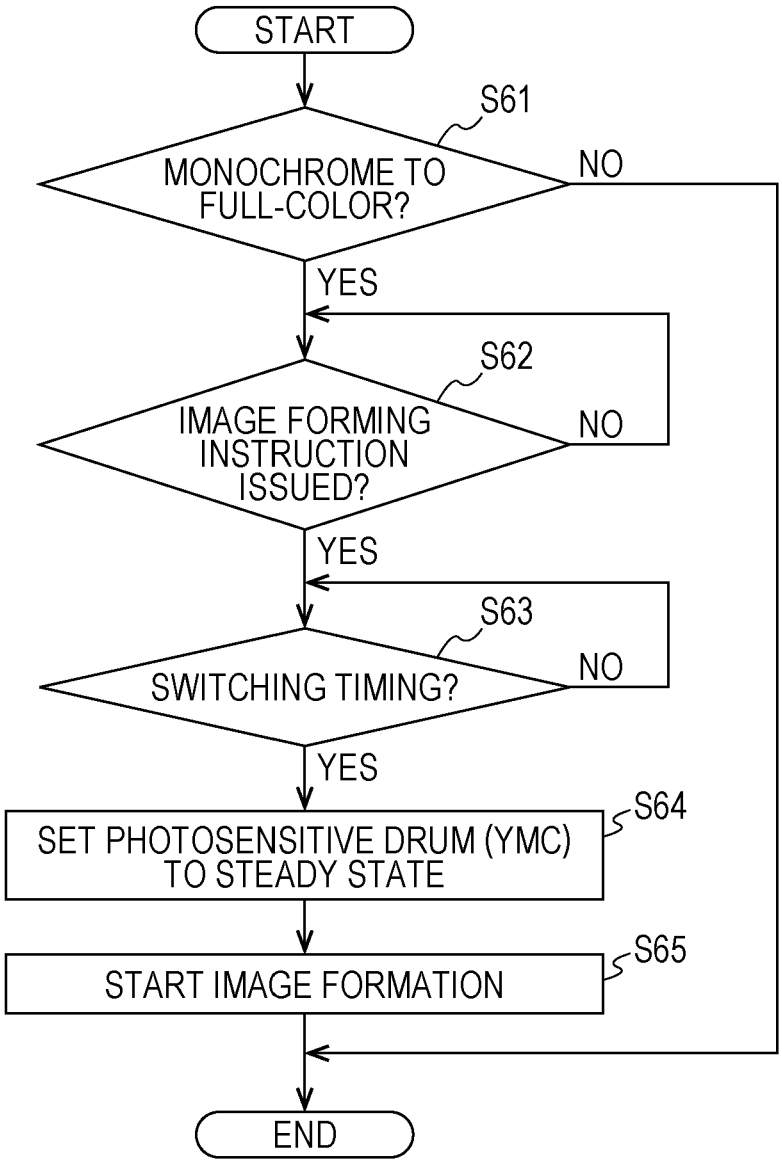
FIG. 18 is a flowchart illustrating procedures for angular switching of the photosensitive drum at the time of switching to the full-color printing mode.

A process for realizing this angular speed setting of the photosensitive drums 21*b* through 21*d* is more specifically described. Before execution of a printing job accumulated in the image forming apparatus 1, the control circuit 7 determines whether or not switching is needed from the monochrome printing mode to the full-color printing mode (step S61 in FIG. 18).

When "Yes", the control circuit 7 sets the angular speed of the photosensitive drums 21*b* through 21*d* to the steady state speed (step S64) based on the speed adjustment signal SSk when the current time is a time for switching the angular speed of the photosensitive drums 21*b* through 21*d* to the steady state speed (step S63) after issue of an instruction for forming a full-color image (S62). Subsequently, formation of a full-color image starts (step S65).

It is preferable that the potential of the charging bias voltages CBb through CBd is returned to the first potential before formation of the full-color image as illustrated in FIG. 14.

Figure 19:
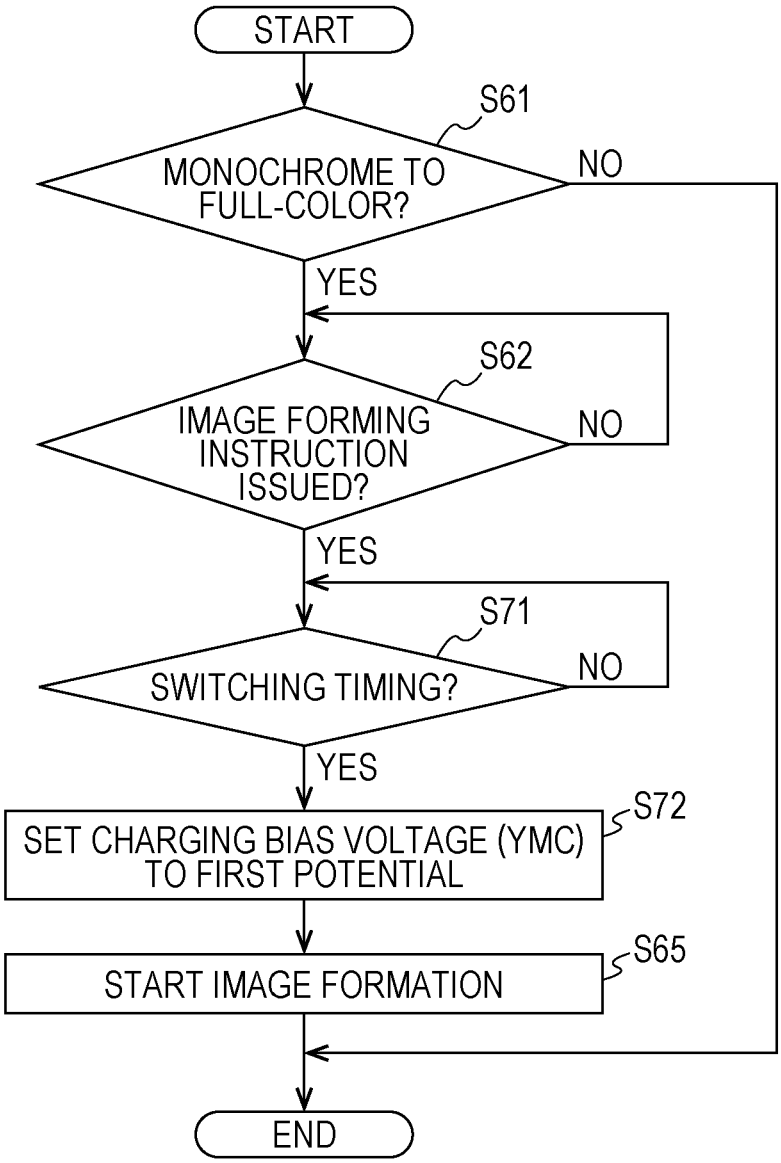
FIG. 19 is a flowchart illustrating procedures for potential switching of the charging bias voltage at the time of switching to the full-color printing mode.

A process for realizing this potential setting of the charging bias voltage CBb through CBd is more specifically described with reference to FIG. 19. FIG. 19 is different from FIG. 18 in that steps S71 and S72 are executed instead of steps S63 and S64. There is no difference between these flowcharts except for the different steps. Steps in FIG. 19 similar to the corresponding steps in FIG. 18 have been given similar step numbers, and the same explanation is not repeated herein.

After step S62, the control circuit 7 switches the potential of the charging bias voltages CBb through CBd to the first potential (step S72) based on the voltage setting signals CVSb through CVSd when the current time is a time for switching the potential of the charging bias voltages CBb through CBd to the first potential (step S71). Subsequently, formation of a monochrome image starts (step S65).

It is further preferable that, before formation of the full-color image, the potential of the charging bias voltages CBb through CBd is initially returned to the first potential, whereafter the angular speed of the photosensitive drums 21*b* through 21*d* is returned to the steady state speed as illustrated in FIG. 14. In this case, unevenness of charging or film reduction of the photosensitive drums 21*b* through 21*d* further decreases.

Figure 20:
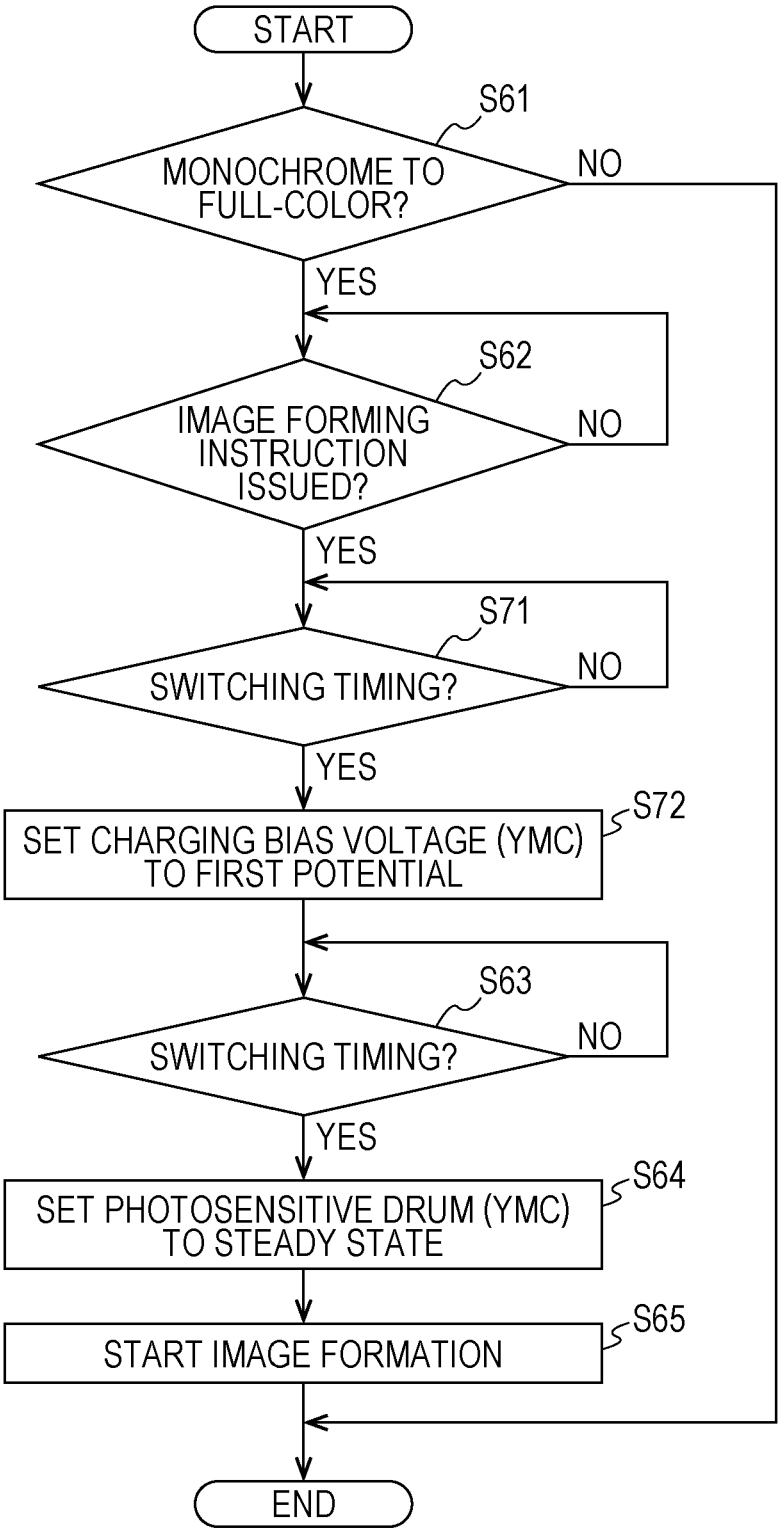
FIG. 20 is a flowchart illustrating procedures for angular speed switching of the photosensitive drum and procedures for potential switching of the charging bias voltage at the time of switching to the full-color printing mode.

A combination process for setting the angular speed of the photosensitive drums 21*b* through 21*d* and for setting the potential of the charging bias voltages CBb through CBd is more specifically described with reference to FIG. 20. FIG. 20 is different from FIG. 19 in that steps S63 and S64 are executed between steps S72 and S65. There is no difference between these flowcharts except for the additional steps. Steps in FIG. 20 similar to the corresponding steps in FIG. 19 have been given similar step numbers, and the same explanation is not repeated herein.

Section 13: Details of Charging Bias Voltage

In the first embodiment, the following points have been described. (1) In the full-color printing mode, all the charging bias voltages CBa through CBd have the first potential. (2) In the monochrome printing mode, the charging bias voltage CBa has the first potential, while the charging bias voltages CBb through CBd have the second potential lower than the first potential. In addition, (3) it is preferable that the second potential is set to an absolute value of the lower limit within the range of output from the dropper circuits 63*b* through 63*d*.

In a more preferable mode, the charging bias voltages CBa through CBd may be determined for each combination of the printing mode, the ambient temperature of the image forming apparatus 1, and the number of rotations of the photosensitive drums 21*a* through 21*d* as illustrated in Tables 3 and 4, under the state of both the conditions (1) and (2). More specifically, in the full-color printing mode, the absolute value of the charging bias voltages CBa through CBd is decreased in accordance with increase in the number of rotations of the photosensitive drums 21*a* through 21*d* regardless of the ambient temperature. In the monochrome printing mode, however, the charging bias voltages CBb through CBd are set to such a value as to meet the condition (3) regardless of the combination of the ambient temperature and the number of rotations. On the other hand, the absolute value of the charging bias voltage CBa is decreased in accordance with increase in the ambient temperature and the number of rotations.

TABLE 3

| CHARGING BIAS VOLTAGE FOR EACH COLOR IN FULL-COLOR PRINTING MODE | | | | | | |
|---|---|---|---|---|---|---|
| | | NUMBER OF ROTATIONS | CHARGING BIAS VOLTAGE | | | |
| PRINTING MODE | AMBIENT TEMPERATURE | OF PHOTOSENSITIVE BODY (TIMES) | CBd (Y COLOR) | CBc (M COLOR) | CBb (C COLOR) | CBa (K COLOR) |
| FULL-COLOR PRINTING MODE | LOWER THAN 20° C. | 0 OR MORE AND LESS THAN 100k | −1600 V | −1600 V | −1600 V | −1600 V |
| | | 100k OR MORE AND LESS THAN 400k | −1400 V | −1400 V | −1400 V | −1400 V |
| | | 400k OR MORE AND LESS THAN 600k | −1200 V | −1200 V | −1200 V | −1200 V |
| | 20° C. OR HIGHER AND LOWER THAN 30° C. | 0 OR MORE AND LESS THAN 100k | −1600 V | −1600 V | −1600 V | −1600 V |
| | | 100k OR MORE AND LESS THAN 400k | −1400 V | −1400 V | −1400 V | −1400 V |
| | | 400k OR MORE AND LESS THAN 600k | −1200 V | −1200 V | −1200 V | −1200 V |
| | 30° C. OR HIGHER | 0 OR MORE AND LESS THAN 100k | −1600 V | −1600 V | −1600 V | −1600 V |
| | | 100k OR MORE AND LESS THAN 400k | −1400 V | −1400 V | −1400 V | −1400 V |
| | | 400k OR MORE AND LESS THAN 600k | −1200 V | −1200 V | −1200 V | −1200 V |

TABLE 4

| CHARGING BIAS VOLTAGE FOR EACH COLOR IN MONOCHROME PRINTING MODE | | | | | | |
|---|---|---|---|---|---|---|
| | | NUMBER OF ROTATIONS | CHARGING BIAS VOLTAGE | | | |
| PRINTING MODE | AMBIENT TEMPERATURE | OF PHOTOSENSITIVE BODY (TIMES) | CBd (Y COLOR) | CBc (M COLOR) | CBb (C COLOR) | CBa (K COLOR) |
| MONOCHROME PRINTING MODE | LOWER THAN 20° C. | 0 OR MORE AND LESS THAN 100k | −1600 V | −800 V | −800 V | −800 V |
| | | 100k OR MORE AND LESS THAN 400k | −1400 V | −800 V | −800 V | −800 V |
| | | 400k OR MORE AND LESS THAN 600k | −1200 V | −800 V | −800 V | −800 V |
| | 20° C. OR HIGHER AND LOWER THAN 30° C. | 0 OR MORE AND LESS THAN 100k | −1400 V | −800 V | −800 V | −800 V |
| | | 100k OR MORE AND LESS THAN 400k | −1200 V | −800 V | −800 V | −800 V |
| | | 400k OR MORE AND LESS THAN 600k | −1000 V | −800 V | −800 V | −800 V |
| | 30° C. OR HIGHER | 0 OR MORE AND LESS THAN 100k | −1200 V | −800 V | −800 V | −800 V |
| | | 100k OR MORE AND LESS THAN 400k | −1000 V | −800 V | −800 V | −800 V |
| | | 400k OR MORE AND LESS THAN 600k | −800 V | −800 V | −800 V | −800 V |

Section 14: Details of Primary Transfer Bias Voltage

The details of the primary bias voltages TBa through TBd are described in Section 9. In a specific example, the primary transfer bias voltages TBa through TBd may be determined for each combination of the printing mode, and the ambient temperature and the system speed of the image forming apparatus 1 as illustrated in Tables 5 and 6. More specifically, in the full-color printing mode, the absolute value of the primary transfer bias voltages TBa through TBd is decreased in accordance with increase in the ambient temperature and with reduction of the system speed. In the monochrome printing mode, however, the primary transfer bias voltages TBb through TBd are set to such a value as to meet the condition (3) described in Section 13 regardless of the combination of the ambient temperature and the number of rotations. On the other hand, the absolute value of the primary transfer bias voltage TBa is decreased in accordance with increase in the ambient temperature and with reduction of the system speed.

TABLE 5

PRIMARY TRANSFER BIAS VOLTAGE FOR EACH COLOR IN FULL-COLOR PRINTING MODE

| PRINTING MODE | AMBIENT TEMPERATURE | SYSTEM SPEED (mm/s) | CHARGING BIAS VOLTAGE TBd (Y COLOR) | TBc (M COLOR) | TBb (C COLOR) | TBa (K COLOR) |
|---|---|---|---|---|---|---|
| FULL-COLOR PRINTING MODE | LOWER THAN 20° C. | 300 | 2800 V | 2800 V | 2800 V | 2800 V |
| | | 200 | 2700 V | 2700 V | 2700 V | 2700 V |
| | | 100 | 2600 V | 2600 V | 2600 V | 2600 V |
| | 20° C. OR HIGHER AND LOWER THAN 30° C. | 300 | 2500 V | 2500 V | 2500 V | 2500 V |
| | | 200 | 2400 V | 2400 V | 2400 V | 2400 V |
| | | 100 | 2300 V | 2300 V | 2300 V | 2300 V |
| | 30° C. OR HIGHER | 300 | 2200 V | 2200 V | 2200 V | 2200 V |
| | | 200 | 2100 V | 2100 V | 2100 V | 2100 V |
| | | 100 | 2000 V | 2000 V | 2000 V | 2000 V |

TABLE 6

CHARGING BIAS VOLTAGE FOR EACH COLOR IN MONOCHROME PRINTING MODE PRINTING MODE

| PRINTING MODE | AMBIENT TEMPERATURE | NUMBER OF ROTATIONS OF PHOTOSENSITIVE BODY (TIMES) | CHARGING BIAS VOLTAGE CBd (Y COLOR) | CBc (M COLOR) | CBb (C COLOR) | CBa (K COLOR) |
|---|---|---|---|---|---|---|
| MONOCHROME PRINTING MODE | LOWER THAN 20° C. | 0 OR MORE AND LESS THAN 100k | −1600 V | −800 V | −800 V | −800 V |
| | | 100k OR MORE AND LESS THAN 400k | −1400 V | −800 V | −800 V | −800 V |
| | | 400k OR MORE AND LESS THAN 600k | −1200 V | −800 V | −800 V | −800 V |
| | 20° C. OR HIGHER AND LOWER THAN 30° C. | 0 OR MORE AND LESS THAN 100k | −1400 V | −800 V | −800 V | −800 V |
| | | 100k OR MORE AND LESS THAN 400k | −1200 V | −800 V | −800 V | −800 V |
| | | 400k OR MORE AND LESS THAN 600k | −1000 V | −800 V | −800 V | −800 V |
| | 30° C. OR HIGHER | 0 OR MORE AND LESS THAN 100k | −1200 V | −800 V | −800 V | −800 V |
| | | 100k OR MORE AND LESS THAN 400k | −1000 V | −800 V | −800 V | −800 V |
| | | 400k OR MORE AND LESS THAN 600k | −800 V | −800 V | −800 V | −800 V |

Section 15: Supplementary Notes

Figure 21:
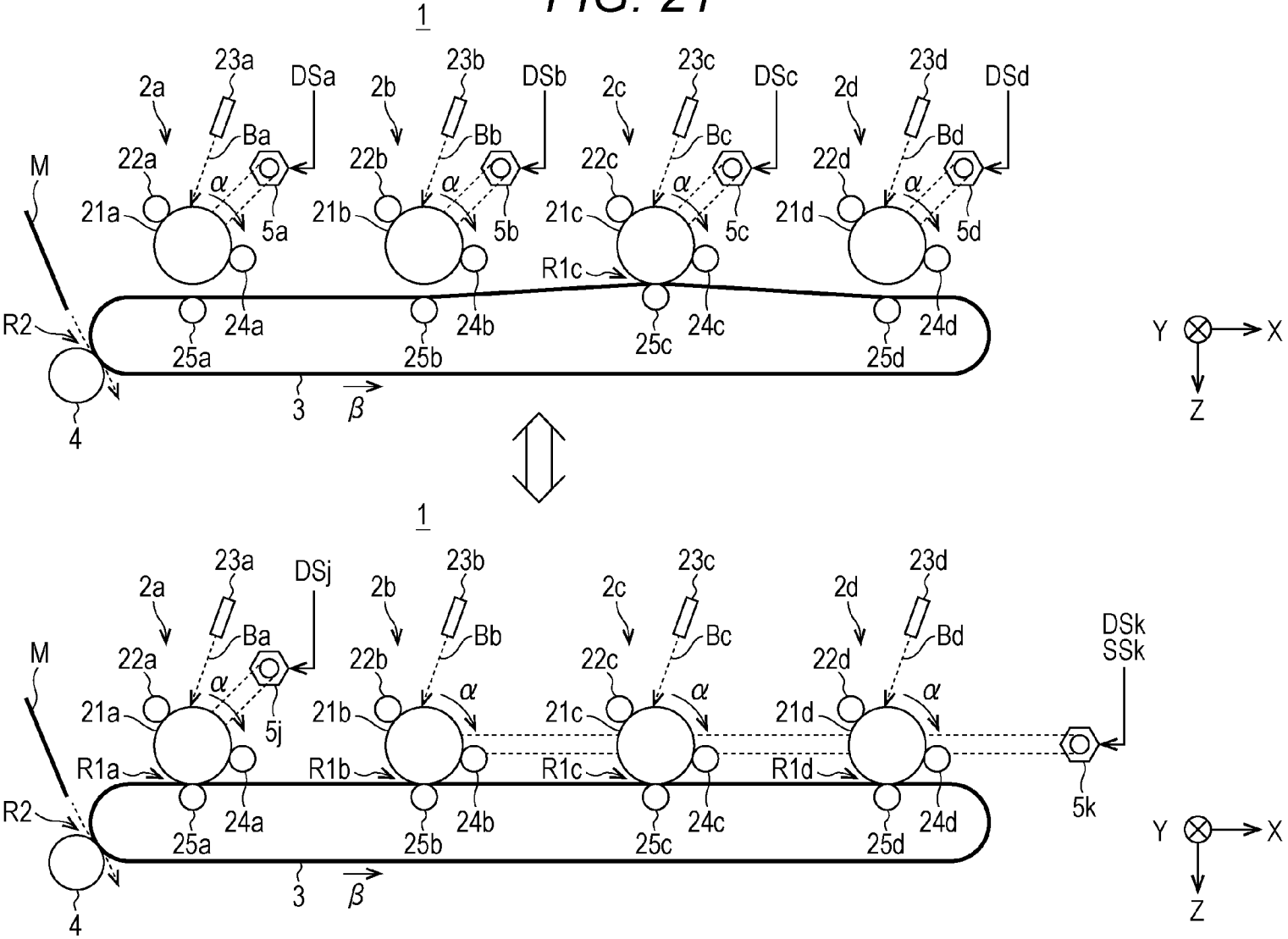
FIG. 21 is a view illustrating a general configuration of another image forming apparatus.
Figure 22:
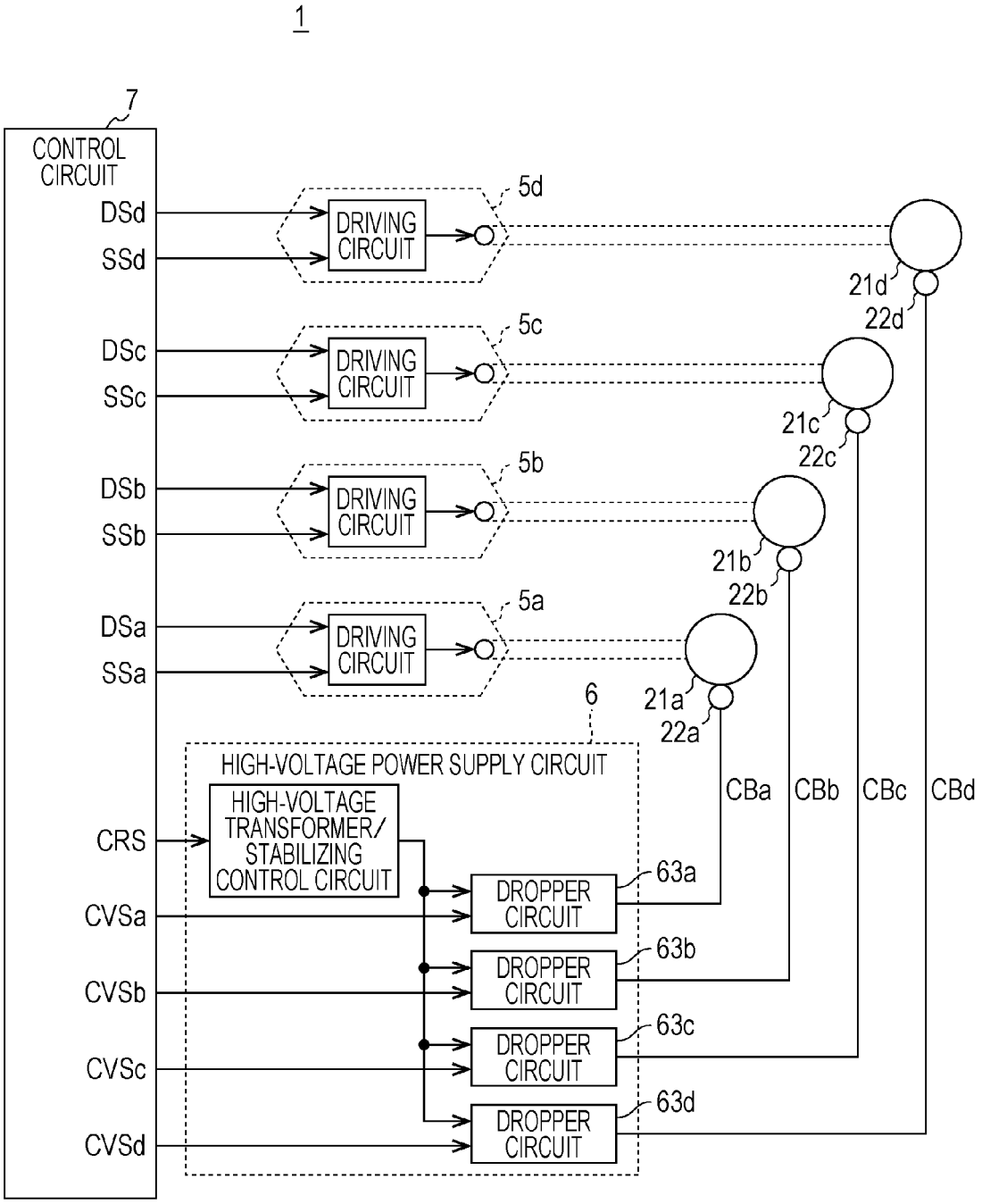
FIG. 22 is a view illustrating a high-voltage power supply circuit and a control circuit included in the image forming apparatus illustrated in FIG. 21.

According to the description herein, the full-color printing mode and the monochrome printing mode are used as a first printing mode and a second printing mode by way of example. However, the first and second printing modes are not limited to these modes. The second printing mode may be a mono-color printing mode. However, this structure requires a mechanism and function for individually separating the image forming units 2*a* through 2*d*, and motors 5*a* through 5*d* for individually giving driving force to the image forming units 2*a* through 2*d* as illustrated in FIGS. 21 and 22. The image forming apparatus 1 further performs a dual-color printing mode. These printing modes may be defined as either the first printing mode or the second printing mode.

The image forming apparatus according to the present invention is capable of reducing influence on a life of a photosensitive drum and/or image deterioration, and therefore is appropriate for a printer, a copy machine, a facsimile machine, or a multifunction machine having these functions.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a plurality of image forming units provided for each of a plurality of colors, each of the image forming units including a photosensitive body and a plurality of types of processing components around the photosensitive body, and forming an image in the corresponding color by electrophotographic system;

a high-voltage power supply circuit capable of generating a bias voltage for the processing components of the same type based on a voltage output from a first transformer; and a control unit that controls a first printing mode using a predetermined number of the image forming units, and a second printing mode using a smaller number of the image forming units than the predetermined number, wherein in the second printing mode, the control unit performs such control that the photosensitive bodies provided on the image forming units not used in the second printing mode continuously rotate at a speed lower than a speed in the first printing mode, and such control that a bias voltage whose absolute value is less than an absolute value of a bias voltage in the first printing mode is supplied from the high-voltage power supply circuit to the processing components of the same type provided on the image forming units not used in the second printing mode, and wherein the high-voltage power supply circuit is capable of simultaneously generating different bias voltages for the processing components of the same type.

2. The image forming apparatus according to claim 1, wherein the first printing mode is a full-color printing mode, in the full-color printing mode, all of the plurality of image forming units are used, the second printing mode is a monochrome printing mode, and in the monochrome printing mode, one of the plurality of image forming units is used.

3. The image forming apparatus according to claim 1, wherein the plurality of types of processing components include charging units, the high-voltage power supply circuit is capable of generating a charging bias voltage for the charging units for the plurality of colors based on a voltage output from the first transformer, and in the second printing mode, the control unit performs such control that the photosensitive bodies provided on the image forming units not used in the second printing mode continuously rotate at a speed lower than a speed in the first printing mode, and such control that a charging bias voltage whose absolute value is less than an absolute value of a charging bias voltage in the first printing mode is supplied from the high-voltage power supply circuit to the charging units provided on the image forming units not used in the second printing mode.

4. The image forming apparatus according to claim 1, wherein the plurality of types of processing components include charging units and developing units, the high-voltage power supply circuit is capable of generating a charging bias voltage for the charging units for the plurality of colors, and a developing bias voltage for the developing units for the plurality of colors, based on voltages output from the first transformer and a second transformer, respectively, and in the second printing mode, the control unit performs such control that the photosensitive bodies provided on the image forming units not used in the second printing mode continuously rotate at a speed lower than a speed in the first printing mode.

5. The image forming apparatus according to claim 1, wherein the plurality of types of processing components include primary transfer units;

the high-voltage power supply circuit is capable of generating a primary transfer bias voltage for the primary transfer units for the plurality of colors based on a voltage output from the first transformer, and in the second printing mode, the control unit performs such control that the photosensitive bodies provided on the image forming units not used in the second printing mode continuously rotate at a speed lower than a speed in the first printing mode.

6. The image forming apparatus according to claim 1, wherein the control unit controls the photosensitive body provided on each of the image forming units not used in the second printing mode such that the number of rotations of the photosensitive body becomes an integer number when the control unit performs, in the second printing mode, such control that the photosensitive bodies provided on the image forming units not used in the second printing mode continuously rotate at a speed lower than a speed in the first printing mode.

7. The image forming apparatus according to claim 6, wherein the control unit determines the number of rotations and an angular speed of the photosensitive body of each of the image forming units not used in the second printing mode based at least on a printing number of sheets in the second printing mode and a printing number of sheets per unit time.

8. The image forming apparatus according to claim 1, wherein the control unit outputs a bias voltage whose absolute value is a lower limit of a range of output from the high-voltage power supply circuit when the control unit performs, in the second printing mode, such control that a bias voltage whose absolute value is less than an absolute value of a bias voltage in the first printing mode is supplied from the high-voltage power supply circuit to the processing components of the same type provided on the image forming units not used in the second printing mode.

9. The image forming apparatus according to claim 1, wherein the control unit outputs a substantially constant bias voltage throughout the second printing mode when the control unit performs, in the second printing mode, such control that a bias voltage whose absolute value is less than an absolute value of a bias voltage in the first printing mode is supplied from the high-voltage power supply circuit to the processing components of the same type provided on the image forming units not used in the second printing mode.

10. The image forming apparatus according to claim 1, wherein the control unit performs such control that the photosensitive bodies provided on the image forming units not used in the second printing mode continuously rotate at a speed lower than a speed in the first printing mode before start of image formation in the second printing mode when the control unit controls the second printing mode after the first printing mode.

11. The image forming apparatus according to claim 1, wherein the control unit performs control for returning an angular speed of the photosensitive body provided on each of the image forming units not used in the second printing mode to an angular speed of the corresponding photosensitive body in the first printing mode before start of image formation in the first printing mode when the control unit controls the first printing mode after the second printing mode.

12. The image forming apparatus according to claim 1, wherein the control unit performs such control that a bias voltage whose absolute value is less than an absolute value of a bias voltage in the first printing mode is supplied from the high-voltage power supply circuit to the processing components of the same type provided on the image forming units not used in the second printing mode before start of image formation in the second printing mode when the control unit controls the second printing mode after the first printing mode.

13. The image forming apparatus according to claim 1, wherein the control unit performs control for returning a bias voltage for the processing components of the same type provided on each of the image forming units not used in the second printing mode to a corresponding bias voltage in the first printing mode before start of image formation in the first printing mode when the control unit controls the first printing mode after the second printing mode.

14. The image forming apparatus according to claim 1, wherein the control unit performs such control that a bias voltage whose absolute value is less than an absolute value of a bias voltage in the first printing mode is supplied from the high-voltage power supply circuit to the processing components of the same type provided on the image forming units not used in the second printing mode, and then performs such control that the photosensitive bodies provided on the image forming units not used in the second printing mode continuously rotate at a speed lower than a speed in the first printing mode before start of image formation in the second printing mode when the control unit controls the second printing mode after the first printing mode.

15. The image forming apparatus according to claim 1, wherein the control unit performs control for returning an angular speed of the photosensitive body provided on each of the image forming units not used in the second printing mode to an angular speed of the corresponding photosensitive body in the first printing mode, and then performs control for returning a bias voltage for the processing components of the same type provided on each of the image forming units not used in the second printing mode to a corresponding bias voltage in the first printing mode before start of image formation in the first printing mode when the control unit controls the first printing mode after the second printing mode.

* * * * *